US007772988B1

(12) United States Patent
Condon et al.

(10) Patent No.: US 7,772,988 B1
(45) Date of Patent: Aug. 10, 2010

(54) LED LIGHT ASSEMBLY WITH PREDETERMINED DISTRIBUTION PATTERN AND BUILT-IN RETROREFLECTOR

(75) Inventors: Patrick J. Condon, Morris, IL (US); Mark B. Pruss, Coal City, IL (US); Hans Christian Lassen, Nevada, IA (US)

(73) Assignee: Innovative Lighting, Inc., Charles City, IA (US)

( * ) Notice: Subject to any disclaimer, the term of this patent is extended or adjusted under 35 U.S.C. 154(b) by 745 days.

(21) Appl. No.: 11/443,840

(22) Filed: May 31, 2006 (Under 37 CFR 1.47)

Related U.S. Application Data

(60) Provisional application No. 60/686,321, filed on May 31, 2005.

(51) Int. Cl.
*G09F 9/33* (2006.01)

(52) U.S. Cl. ..... 340/815.45; 340/815.4; 340/815.49; 340/815.5; 340/815.55; 340/815.57; 340/431; 340/468; 362/509; 362/511; 362/514; 362/516; 362/520; 359/19; 359/457; 359/556

(58) Field of Classification Search ..... 340/815.45, 340/815.4, 815.49, 815.5, 815.55, 815.73, 340/431, 463, 468, 908; 362/231, 249, 333, 362/487, 494, 485, 545, 555, 641, 511, 31, 362/540, 544, 559, 554, 518, 520, 521, 249.01–249.19; 359/19, 457, 557
See application file for complete search history.

(56) References Cited

U.S. PATENT DOCUMENTS 4,959,757 A * 9/1990 Nakata ..... 362/518
6,099,156 A * 8/2000 Jenkins et al. ..... 362/511
6,305,830 B1 * 10/2001 Zwick et al. ..... 362/520
6,450,663 B1 * 9/2002 Reinbach ..... 362/249
6,547,423 B2 * 4/2003 Marshall et al. ..... 362/333
6,612,728 B2 * 9/2003 Roller et al. ..... 362/521
6,646,813 B2 * 11/2003 Falicoff et al. ..... 359/641
2005/0111235 A1 * 5/2005 Suzuki et al. ..... 362/555

OTHER PUBLICATIONS

SAE Surface Vehicle Standard, "Tail Lamps (Rear Position Lamps) for Use on Vehicles 2032 mm or More in Overall Width", Revised Mar. 2000 (8 pages).

LUMILEDS, Application Brief AB21, "Luxeon Product—Binning and Labeling" Feb. 2005 (7 pages).

LUMILEDS, Technical Datasheet DS23, "power light source, Luxeon Star", Apr. 2005) (19 pages).

* cited by examiner

*Primary Examiner*—George A Bugg
*Assistant Examiner*—Sisay Yacob
(74) *Attorney, Agent, or Firm*—McKee, Voorhees & Sease, P.L.C.

(57) ABSTRACT

An apparatus and method for producing specified output intensity distribution requirements from a single LED source, wherein the apparatus includes a single LED source and a cover, including a lens, that captures and controls the non-collimated light of the LED source and limits its spread vertically and horizontally as well as producing intensity variations within the output pattern. In one aspect of the invention, the lens is on the same order of size as the LED source, the cover has an exposed surface area several times larger than the area of the lens and is primarily configured to have retroreflective properties.

46 Claims, 20 Drawing Sheets
(4 of 20 Drawing Sheet(s) Filed in Color)

LIGHT OUTPUT CHART

| x-axis | y-axis |
|---|---|
| -0.269 | 0.338 |
| -0.263 | 0.327 |
| -0.256 | 0.317 |
| -0.25 | 0.308 |
| -0.243 | 0.298 |
| -0.237 | 0.289 |
| -0.23 | 0.28 |
| -0.223 | 0.271 |
| -0.217 | 0.262 |
| -0.21 | 0.253 |
| -0.204 | 0.245 |
| -0.197 | 0.357 |
| -0.191 | 0.346 |
| -0.185 | 0.335 |
| -0.179 | 0.324 |
| -0.173 | 0.313 |
| -0.167 | 0.303 |
| -0.161 | 0.293 |
| -0.155 | 0.283 |
| -0.149 | 0.273 |
| -0.143 | 0.264 |
| -0.137 | 0.255 |
| -0.134 | 0.319 |
| -0.121 | 0.312 |
| -0.108 | 0.306 |
| -0.094 | 0.301 |
| -0.081 | 0.295 |
| -0.067 | 0.291 |
| -0.054 | 0.287 |
| -0.04 | 0.284 |
| -0.027 | 0.282 |
| -0.013 | 0.282 |
| 0 | 0.284 |

Fig. 22

LED LIGHT ASSEMBLY WITH PREDETERMINED DISTRIBUTION PATTERN AND BUILT-IN RETROREFLECTOR

PRIORITY STATEMENT

This application claims priority to U.S. Provisional Patent Application No. 60/686,321, filed May 31, 2005, herein incorporated by reference in its entirety.

I. BACKGROUND OF THE INVENTION

A. Field of the Invention

The present invention relates to lights utilizing an LED source. In particular, it relates to a lens adapted for use with the LED source to produce a predetermined output pattern in angle space. Optionally, it can additionally provide a retroreflective function for a variety of uses, including but not limited to, lighted markers or functional lighting for automotive vehicles and trailers.

B. Problems in the Art

Light emitting diodes (LEDs) have advantageous characteristics. They tend to be durable and shock resistant. They usually are long-lived. They also make efficient use of electrical power. They can be manufactured in small packages and thus present flexibility in design of light assemblies.

On the other hand, they are usually more expensive than other light sources such as incandescent sources. While incandescent sources tend to be substantially less robust, less power efficient and have shorter life expectancy, their development over the decades, and their inherent make up, allow them to be manufactured and sold for a very economical cost.

Still further, the amount of light output from individual LEDs is limited. While advances continue regarding lumen output for LEDs, there has been a hesitancy to move in the direction of using LEDs for lighting applications, particularly those involved with illumination, because of this limitation. This is particularly true in lighting applications where cost sensitivity is high.

One example is automotive lighting for semi-tractor trailers. Government regulations set forth minimum requirements for such things as side marker lights, clearance lights, and even brake and turn signal lights. A minimum amount of light energy is required at least in certain portions of the output distribution or beam of the light. Additionally, many of these lights must adhere to minimum intensity requirements in a predefined distribution pattern or geometric pattern. For example, an amber-colored side marker light for a semi-tractor trailer is required by DOT regulations or standards to have a minimum intensity at selected measurement points in a rectangular pattern. In other words, to meet the standards, the beam or output distribution of the light assembly must cover the rectangular pattern, and the intensity of the beam at the measurement points within the pattern must meet minimums. Such regulations for semi-tractor trailer amber side marker lights are publicly available.

Theoretically, the ways such a light could be designed to meet such requirements are almost unlimited. However, a practical semi-tractor trailer side light has certain design constrictions.

It has to be relatively small, compact, and thin in dimensions so that it can fit along the side of the trailer and not protrude very much out of the plane of the sidewall of the trailer or take up much space inwardly of that plane.

It must be economical. Some tractor trailers require a plurality of these lights. Since their function is to just provide visual marking of the physical side of the trailer, anything other than very low cost cannot be practically justified.

It must be relatively low power. It is powered by the truck's on-board electrical system. Sometimes the lights must be operated just on battery power.

It must be somewhat durable. It will be exposed to all sorts of environmental conditions and external forces.

The conventional state-of-the-art side marker is an incandescent source with a plastic, amber-colored, simple cover. Most incandescent sources emit a spherical or hemispherical ball of light (see cone in dashed lines in FIG. 1). Thus, an incandescent source with simple (non-optical) amber cover, would emit a diffuse ball of light. However, because incandescent sources are relatively inexpensive, to meet the minimum intensity requirements in a more constricted rectangular output pattern required by DOT regulations, higher intensity incandescent bulbs are used to basically blast light out to exceed minimums in the rectangle. However, a substantial amount of light falls outside the rectangle and therefore is essentially wasted relative to the minimums of the regulatory requirements. This is presently justified, however, again by the relatively low cost of relatively powerful incandescent sources. To keep the cost down, very simple, economical plastic covers are used. While more complex lenses or optical structures in the covers could be used with incandescent sources, they would be more costly and have been avoided in the art.

There have been attempts to move to LED sources for such lights. However, as mentioned, the limitations on intensity from such sources have resulted in those attempts using multiple LEDs to gain what is believed to be the needed intensity to meet the regulations. However, the cost of an LED source is the primary cost of such lights. Using plural LEDs makes them substantially more expensive and hard to justify for such applications even though they would be likely more robust, last longer in operating life, and not be substantially different than incandescent sources in power efficiency.

Another factor has come into play regarding these types of lights. Owners/operators of semi-tractor trailer combinations like to have certain aesthetic appearance for their lights. For example, some owners like a round-shaped light fixture. Others like rectangular. This is not much of an issue for incandescent sources which have a simple plastic cover and "blast" light out in a spherical or circular pattern. The simple lens can easily molded to different shapes. However, if any optics or lensing is used to try to control the light, it makes it difficult to design.

Still further, because some of these lights are recessed, the ability to retrofit the fixture or assembly into existing mounting structure on the tractor trailers would usually be advantageous. This would be a valuable consideration.

Still further, some regulations require both illumination and retroreflectance functions for certain vehicles. It would be desirable to be able to satisfy some of these multiple requirements with one lighting fixture.

Other semi-tractor trailer lighting applications have similar issues or concerns as side marker lights. Still further, other automotive lighting applications, for example, for other types of automobiles, including but not limited to cars, other types of trucks, and other types of trailers, have similar issues. And, other lighting applications outside of automotive applications have analogous issues.

It has therefore been identified that there is a real need in the art for improvement in this area.

II. SUMMARY OF THE INVENTION

It is therefore a principal object, feature, advantage, or aspect of the present invention to present a method and apparatus for creating a controlled light energy distribution pattern from a single LED source which improves over or solves problems and deficiencies in the art. Other objects, features, advantages or aspects of the present invention include an apparatus and method as above described which:

a) produces an output pattern which is efficient and cost effective.

b) is durable, shock resistant, and robust even for out doors automotive or over-the-road semi-tractor trailer environments and uses.

c) is efficient in utilization of electrical power but produces sufficient intensity distribution.

d) manages heat efficiently.

e) provides flexibility of design for even very small perimeter dimensions or relatively small thickness dimensions for the lighting assembly.

f) is very flexible in design regarding different lighting applications.

g) is economical to manufacture.

h) is non-complex.

i) efficiently converts a non-collimated source into a non-spherical pattern, if desired.

j) optionally can be placed in a multi-functional light assembly, for example, both an illuminating light assembly and a retroreflective light assembly.

These and other objectives, features, advantages, or aspects of the present invention will become more apparent with reference to the accompanying specification and claims.

In one aspect of the invention, an apparatus comprises a single LED source. The single LED source is covered by a member which includes a lens. The lens is configured to convert the generally conical output of the LED source into a distribution of specific intensities at certain portions of the distribution. In one aspect of the apparatus, the particular intensities meet or exceed DOT/SAE regulations or standards for a particular automotive lighting application. The lens is designed to reconfigure the output of the LED source to more closely follow the output distribution perimeter of the regulations to focus intensity within the pattern to allow a single LED source to meet the intensity minimums. The lens comprises a relatively small, generally symmetrical member with a central portion comprised of generally a surface of partial revolution, side walls, and end walls with a set of tooth-shaped Fresnel facets at each end wall.

In another aspect of the apparatus, intensity varies in the pattern but is designed to meet the minimums in a test pattern.

In another optional aspect of the apparatus, the lens is installed in a cover. The lens is relatively small in perimeter dimensions relative to the overall area of the cover. The lens is on the order of size of the source. The area of the cover is a plurality of times bigger than the area of the lens. The bigger area of the lens is configured to provide retroreflective characteristics such that the light assembly apparatus both illuminates and meets reflective requirements in one assembly.

In another aspect of the invention, a method comprises utilizing a single LED as a light source. The output pattern of the LED is reconfigured into a predetermined pattern. The pattern meets intensity minimums according to a regulatory authority.

Another aspect of the method includes integrating a retroreflective function in the same assembly as the lens.

Another aspect of the invention includes a method for maximizing the area of a reflector by minimizing a lens for illumination purposes. The remainder of the lens area is utilized for reflective purposes.

Another aspect of the invention comprises an efficient lens for converting light energy from a single LED source into a predetermined intensity distribution pattern in angle space. The lens comprises a relatively small first surface, including elements which limit the output beam pattern along a first axis, and has other portions which limit the spread of the beam along an orthogonal axis.

According to another aspect of the invention, the lens further allows selective distribution of intensity within the output pattern.

Further aspects of the invention includes application of the foregoing apparatus and methods to a wide variety of lighting applications. One of the lighting applications is for a side marker for a semi-tractor trailer combination or for other trailers or vehicles. Another aspect is a combined function stop, turn, tail light assembly. Other applications are possible.

III. BRIEF DESCRIPTION OF THE DRAWINGS

The file of this patent contains at least one drawing executed in color. Copies of this patent with colored drawing (s) will be provided by the Patent and Trademark Office upon request and payment of the necessary fee.

Figure 2:
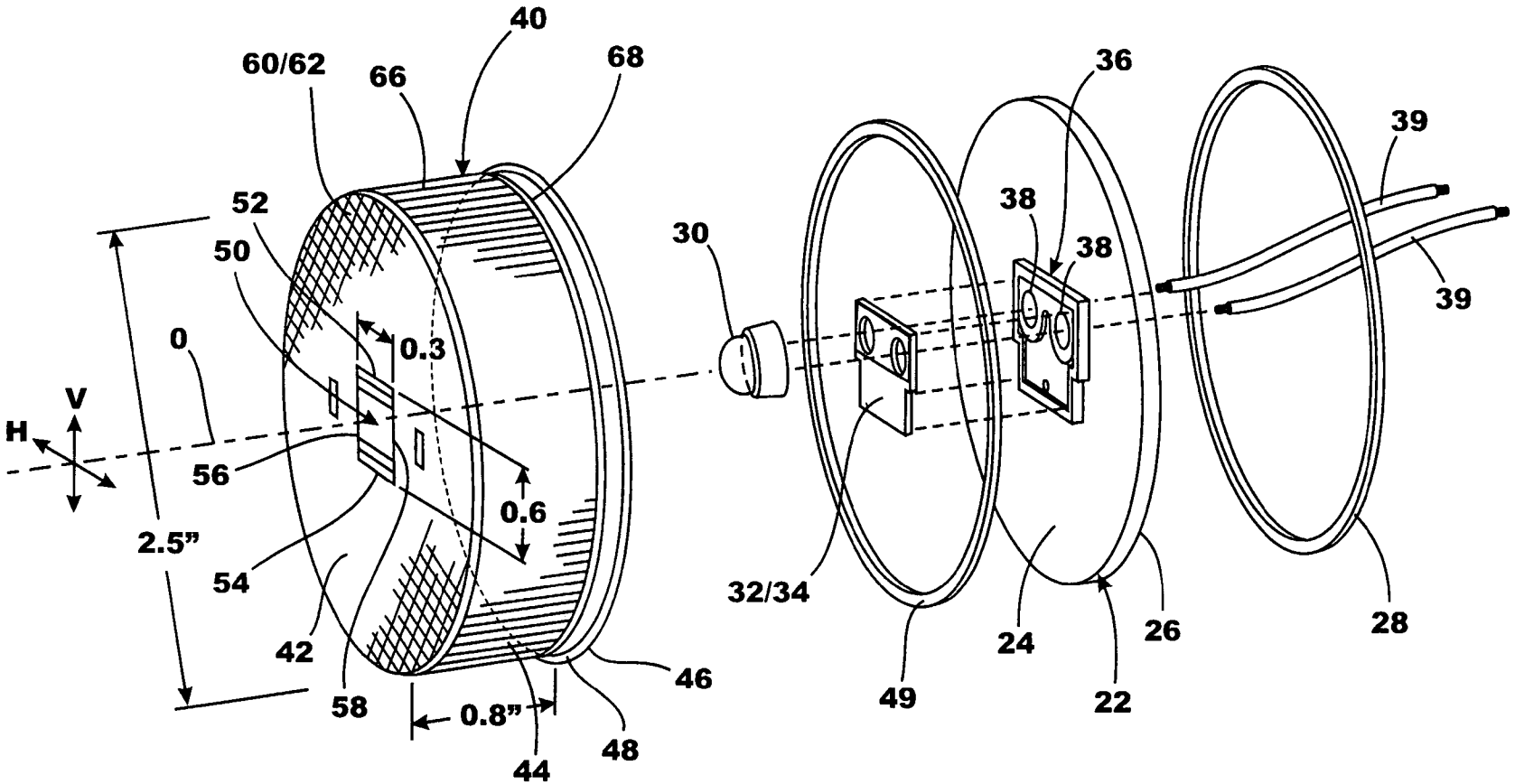
FIG. 2 is an isolated, enlarged exploded view of the side marker light referred to above with regard to FIG. 1.
Figure 3A:
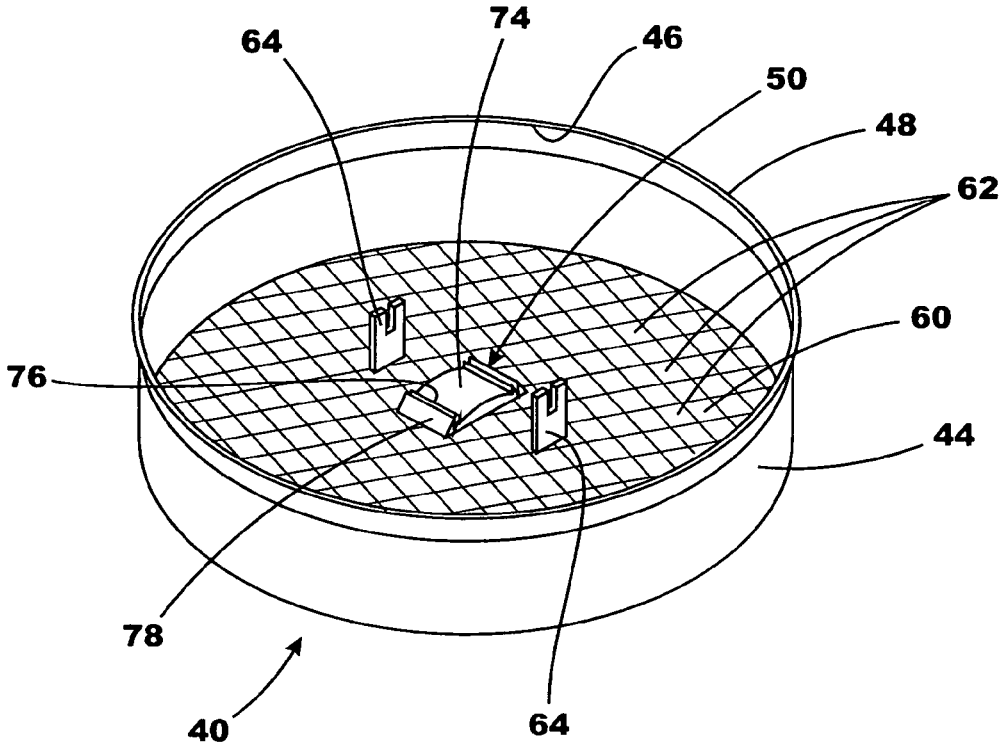
Figure 3B:
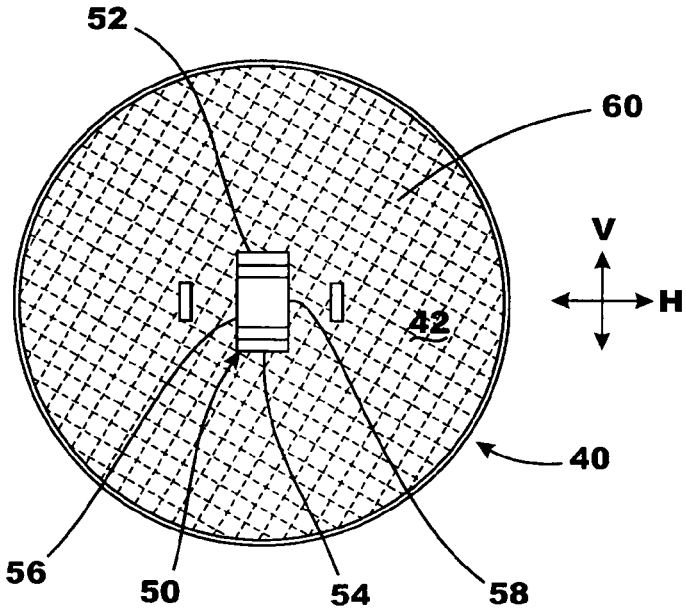
Figure 3C:
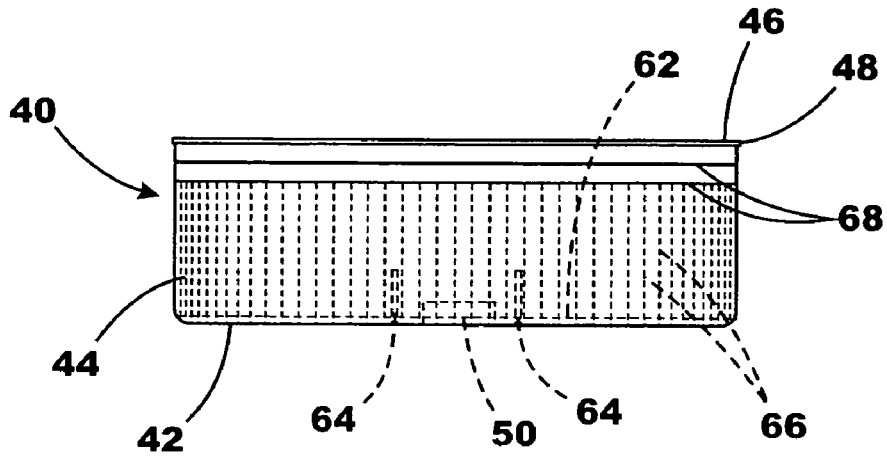
Figure 3D:
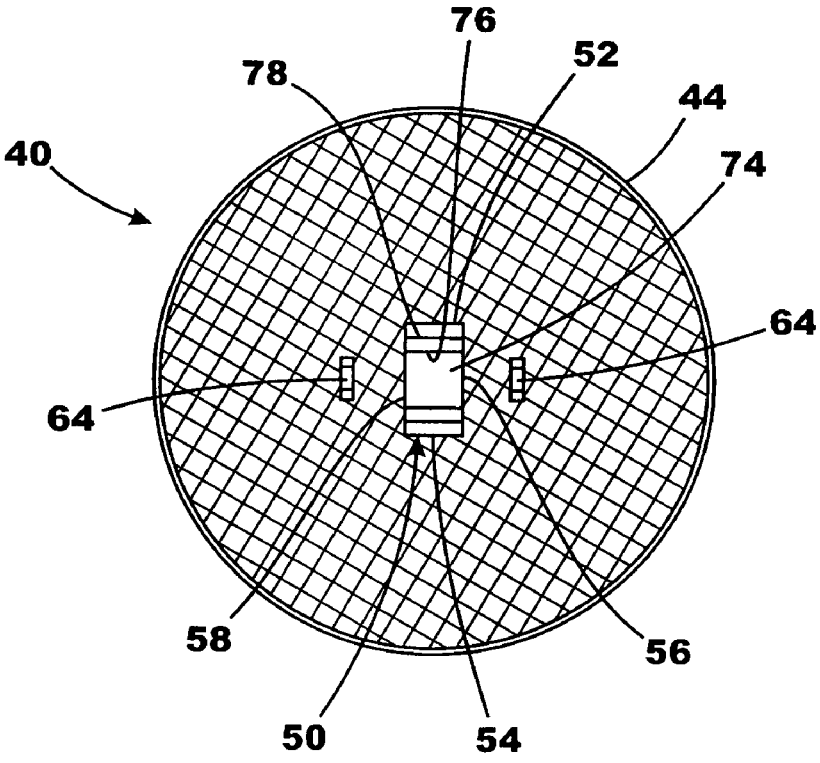
Figure 3E:
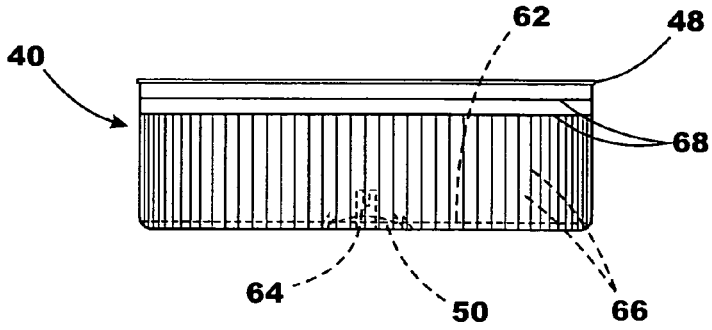

FIGS. 3A-E are isometric views of the cover for the side marker light assembly of FIG. 2. FIG. 3A is a perspective view of the back and side of the cover. FIG. 3B is a front elevation of FIG. 3A. FIG. 3C is a bottom end view of FIG. 3B. FIG. 3D is a back elevation view. FIG. 3E is a side elevation of FIG. 3B.

Figure 4:
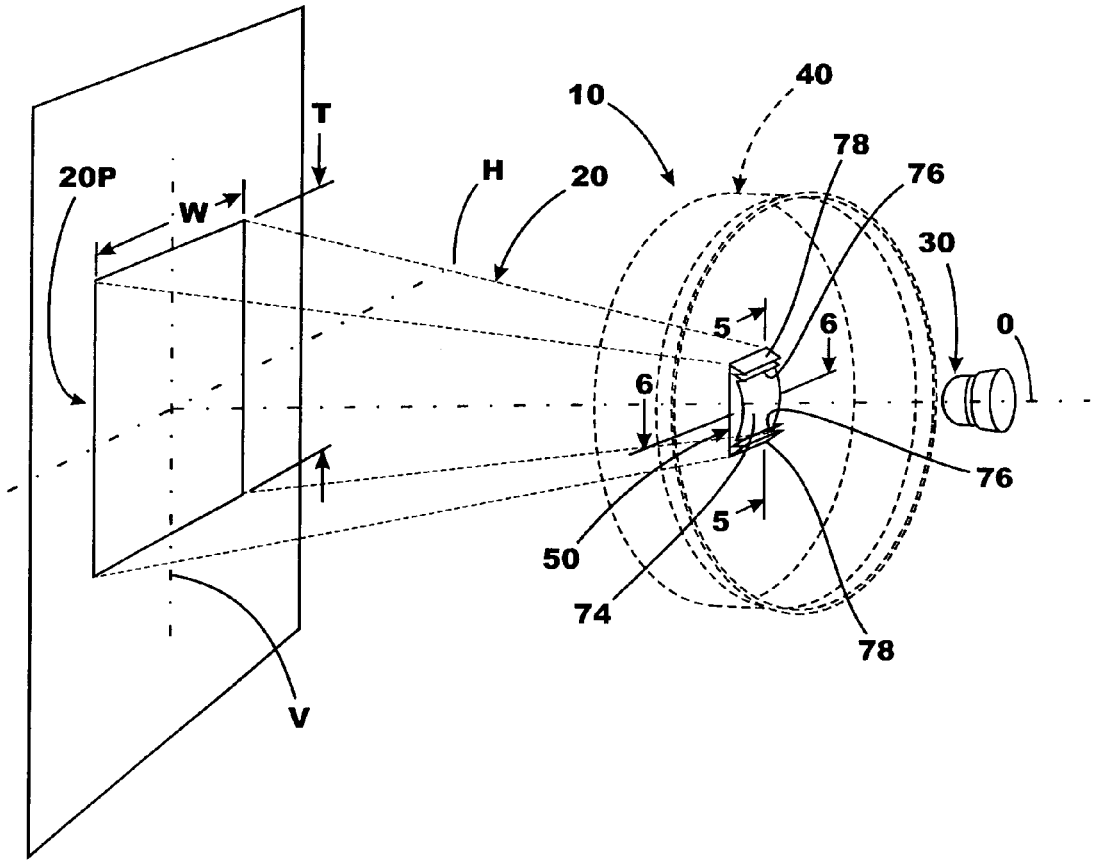

FIG. 4 is an isolated perspective view of the lens of the cover of FIGS. 3A-E and a rough diagrammatic depiction of the perimeter of the output pattern from the lens and a single LED source, such as shown in the light assembly of FIG. 2.

Figure 5:
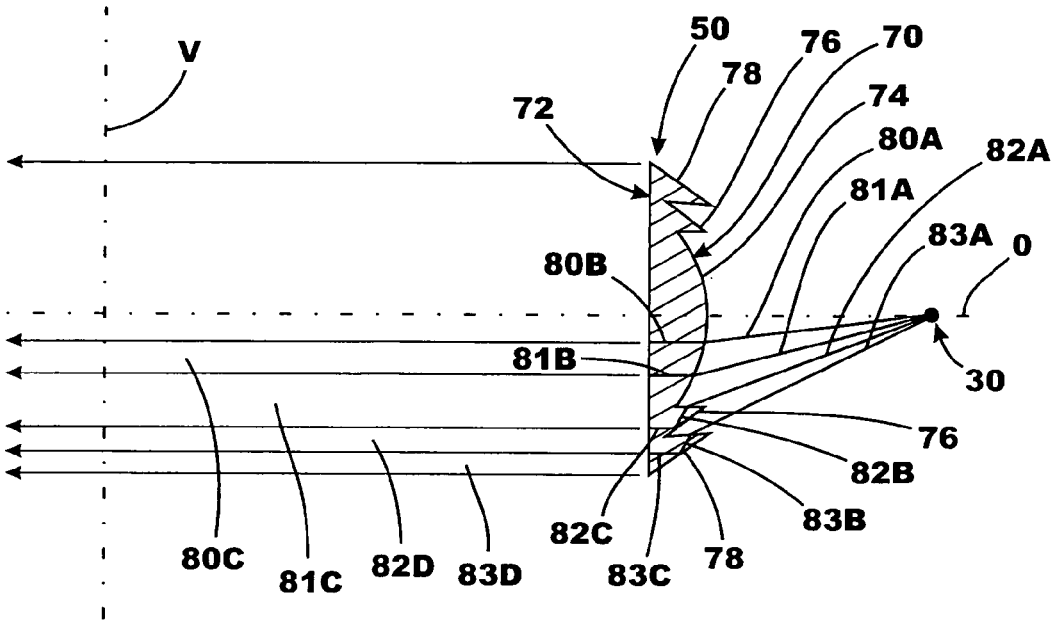

FIG. 5 is an enlarged sectional view taken along line 5-5 of FIG. 4 roughly indicating the control of beam spread from the lens of FIG. 4 in a vertical plane.

Figure 6:
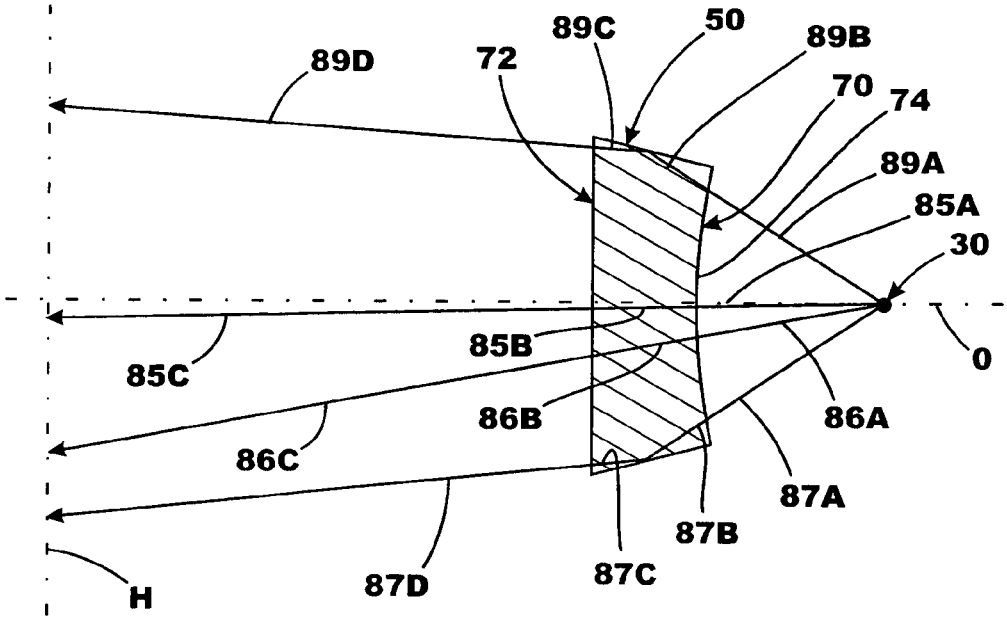

FIG. 6 is similar to FIG. 5 but for the cross-section of the lens of FIG. 4 taken along line 6-6, showing a rough approximation of limitation on beam spread in a horizontal plane.

Figure 7:
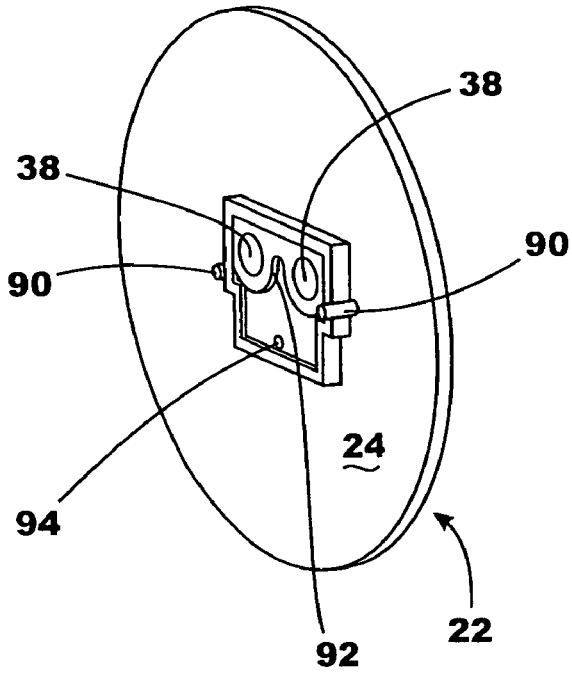

FIG. 7 is an isolated enlarged perspective view of a back plate for the light assembly of FIG. 2, showing its side facing the cover.

Figure 8:
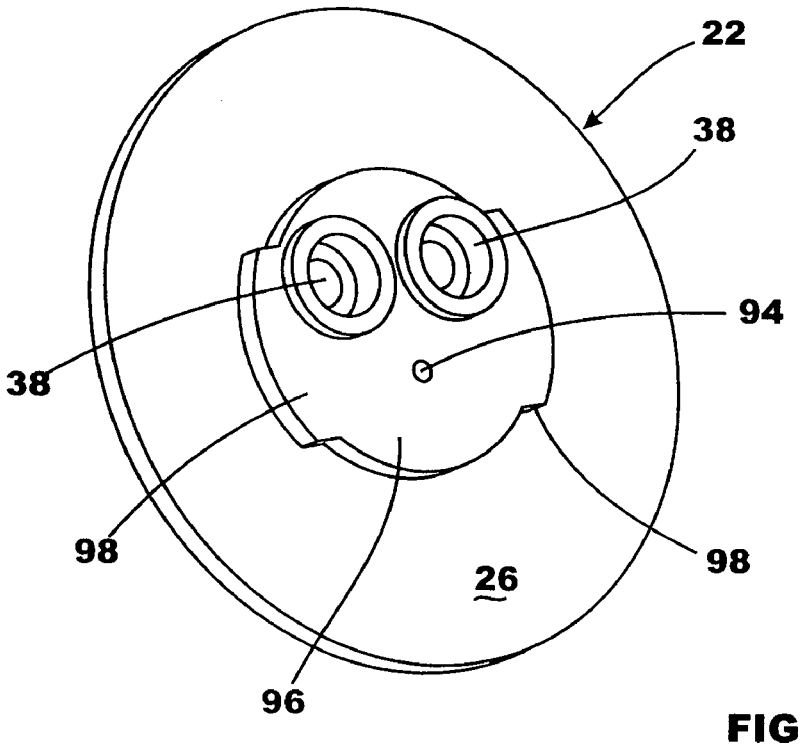

FIG. 8 is an enlarged perspective view of the opposite side of the back plate of FIG. 7.

Figure 9:
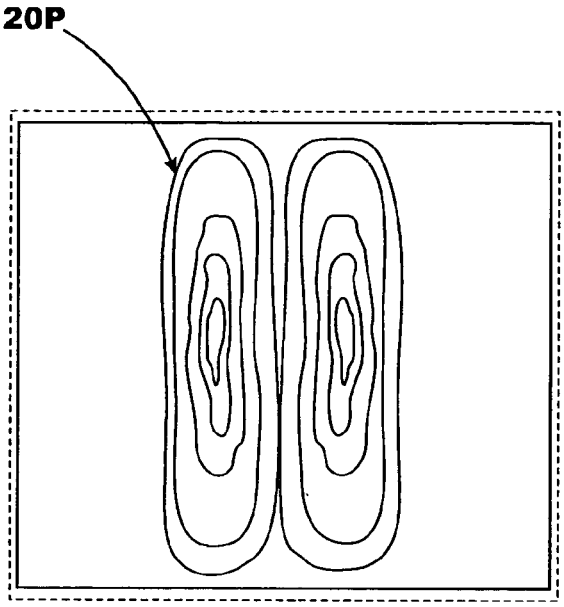

FIG. 9 is a rough diagrammatic depiction of a projection of the light output pattern from the light assembly of FIG. 2, showing the general shape.

Figure 10:
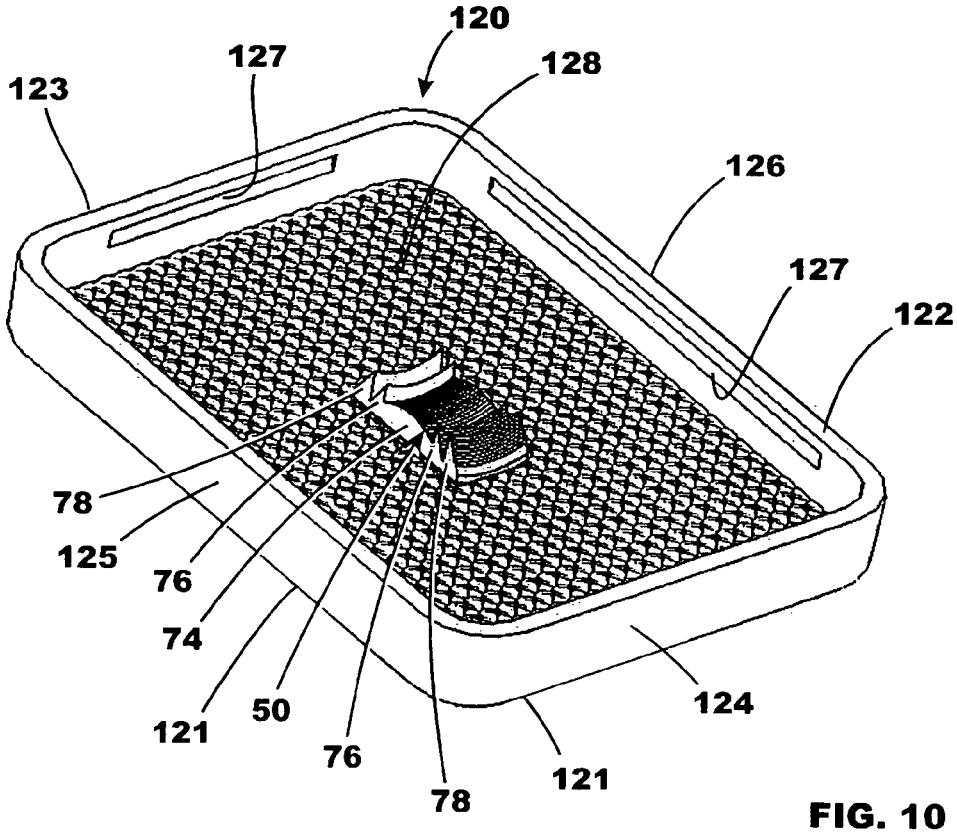

FIG. 10 is a perspective view of the inner side of an alternative cover according to the present invention. This alternative cover is for a rectangular lighting assembly, as opposed to the circular one of FIG. 2.

Figure 11:
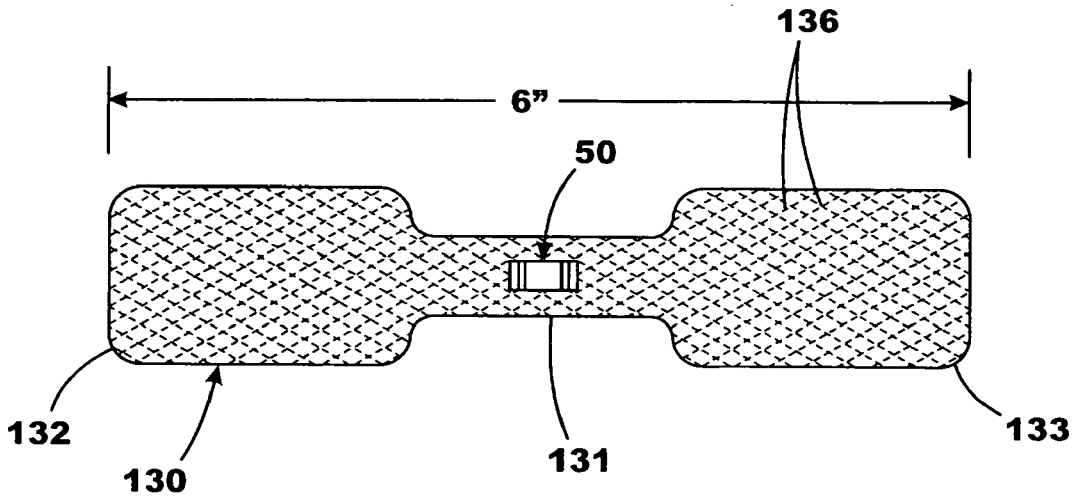

FIG. 11 is a front elevation view of a still further embodiment according to the present invention.

Figure 12:
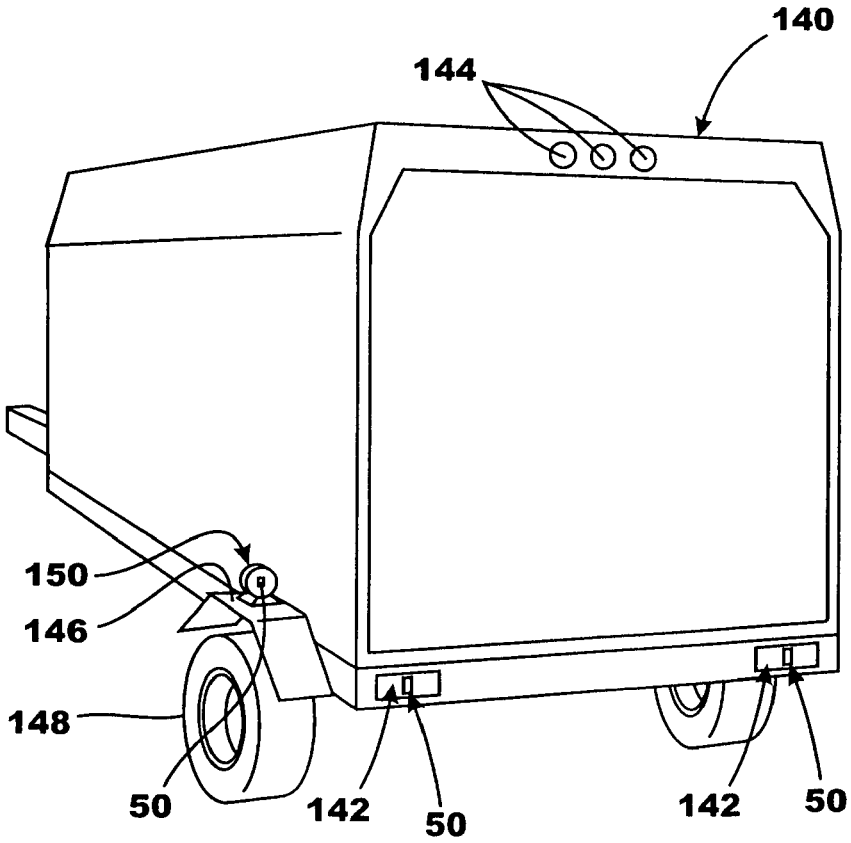

FIG. 12 is a simplified perspective view of a single axle trailer showing several other embodiments of light assemblies according to the present invention.

Figure 13:
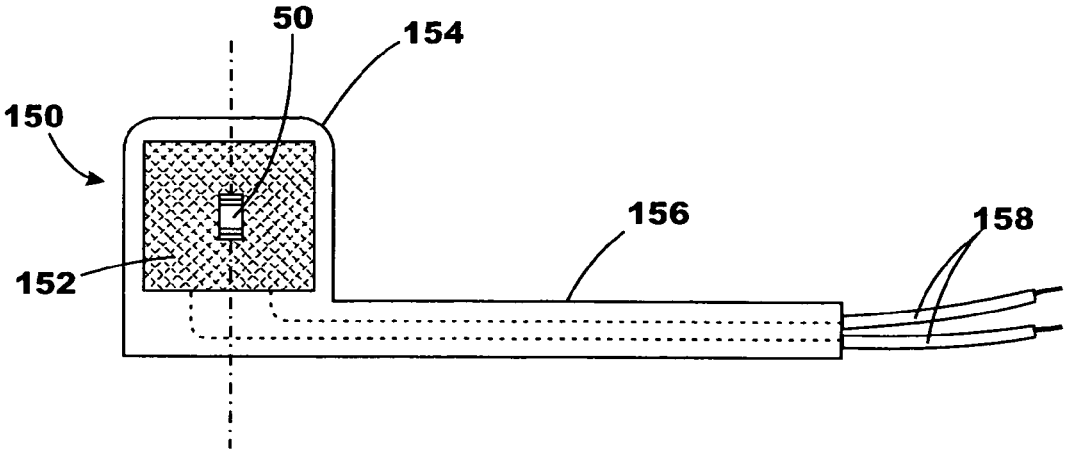

FIG. 13 is an enlarged elevation view of an alternative fender light to that shown in FIG. 12.

Figure 14A:
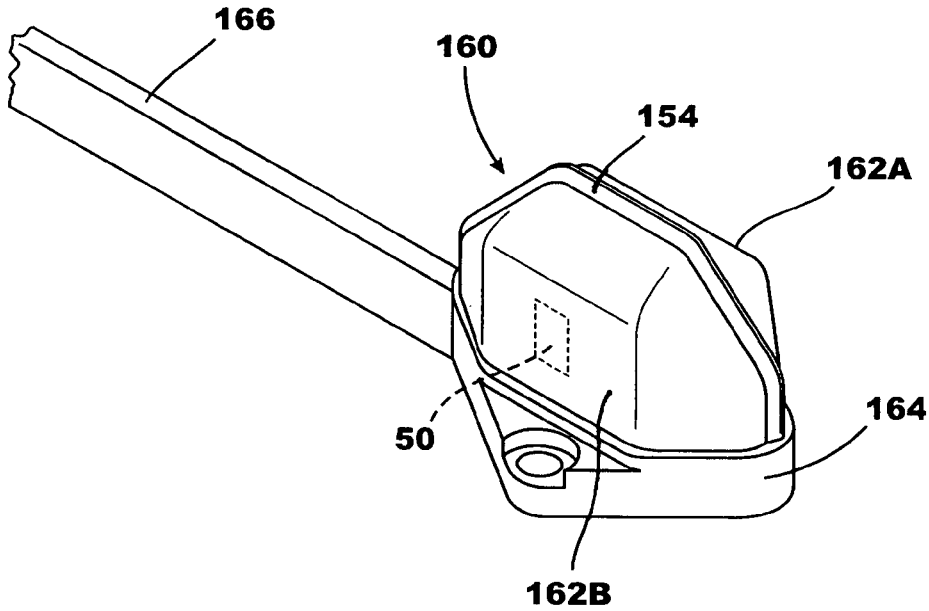
Figure 14B:
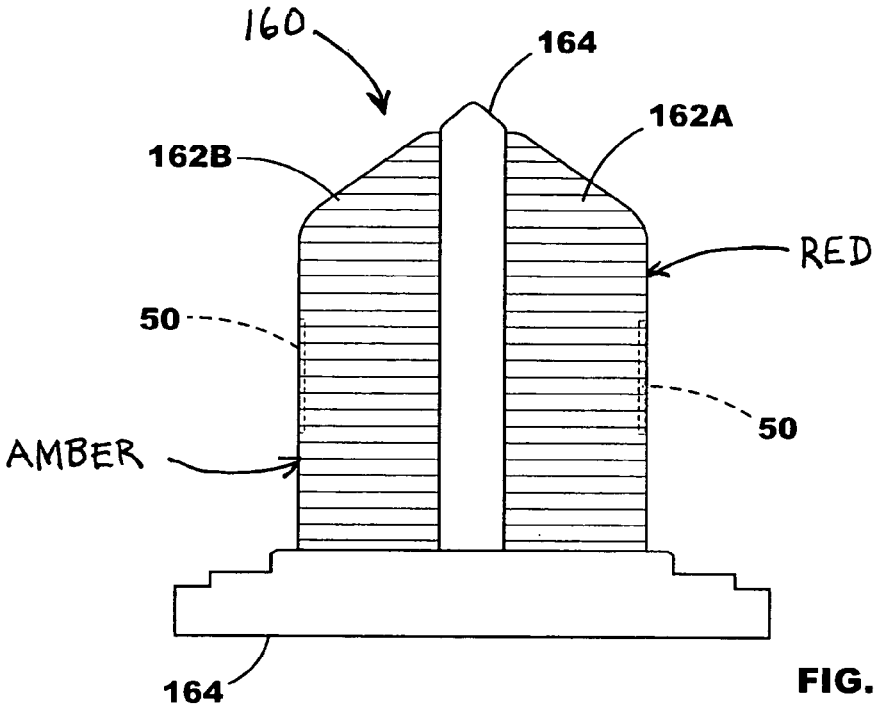

FIGS. 14A and B are perspective and side view, respectively, of a still further alternative embodiment for a fender light.

Figure 15:
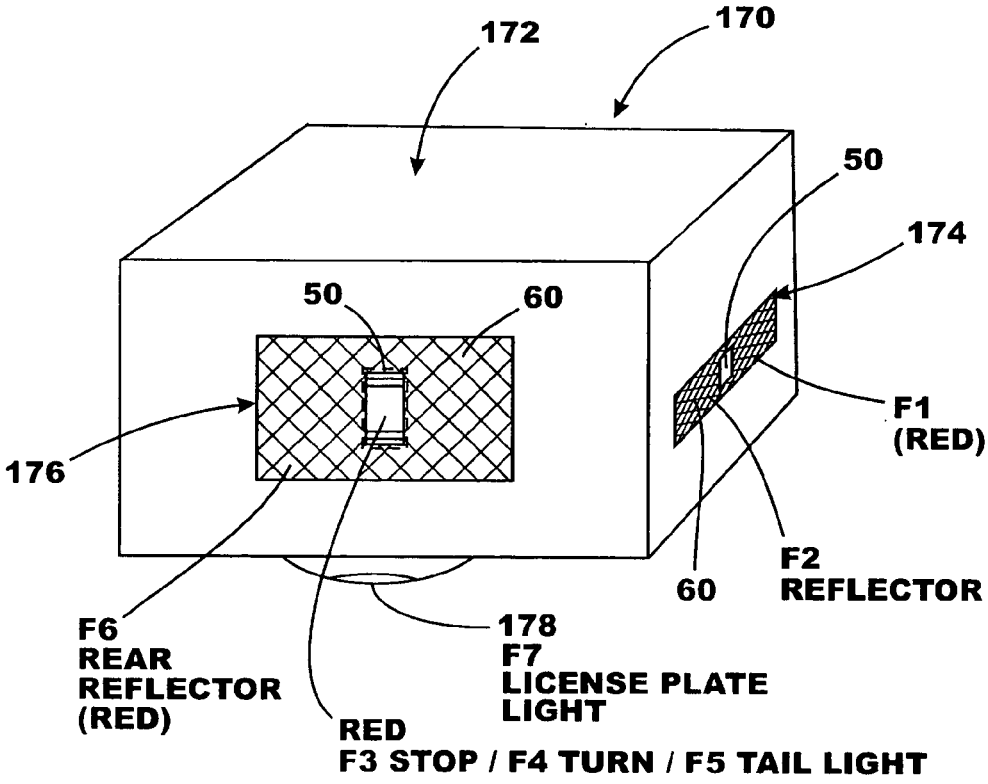

FIG. 15 is a perspective illustration of a multi-functional box light, here having a stops/turn/tail light on one side, and a side marker on the other side, both according to the present invention.

Figure 16:
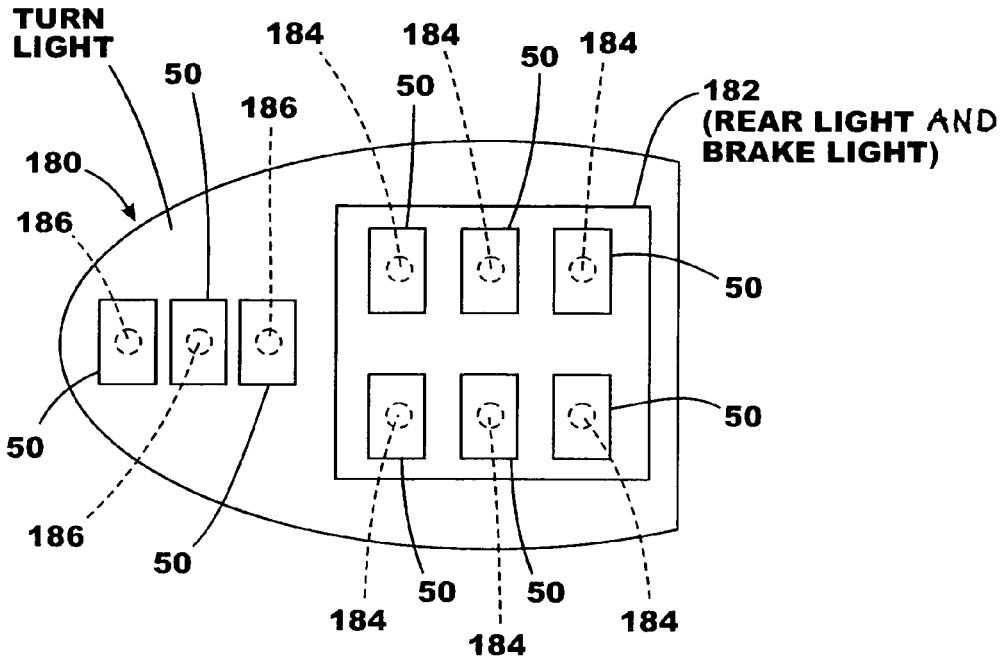

FIG. 16 is a front elevational diagram of an alternative embodiment for a stop/turn/tail light according to the present invention.

Figure 1:
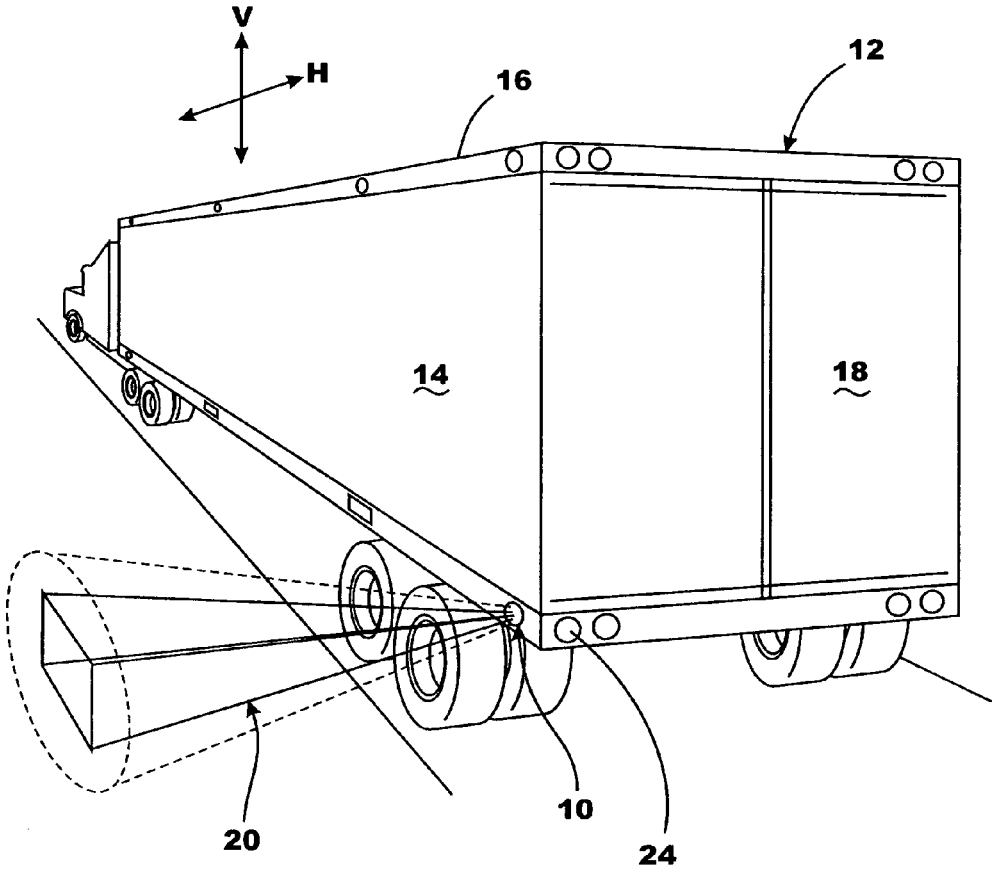
FIG. 1 is a diagrammatic perspective view of a semi-tractor trailer having a variety of functional lights. The output pattern from a side marker light according to the present invention is illustrated for exemplary purposes.
Figure 17A:
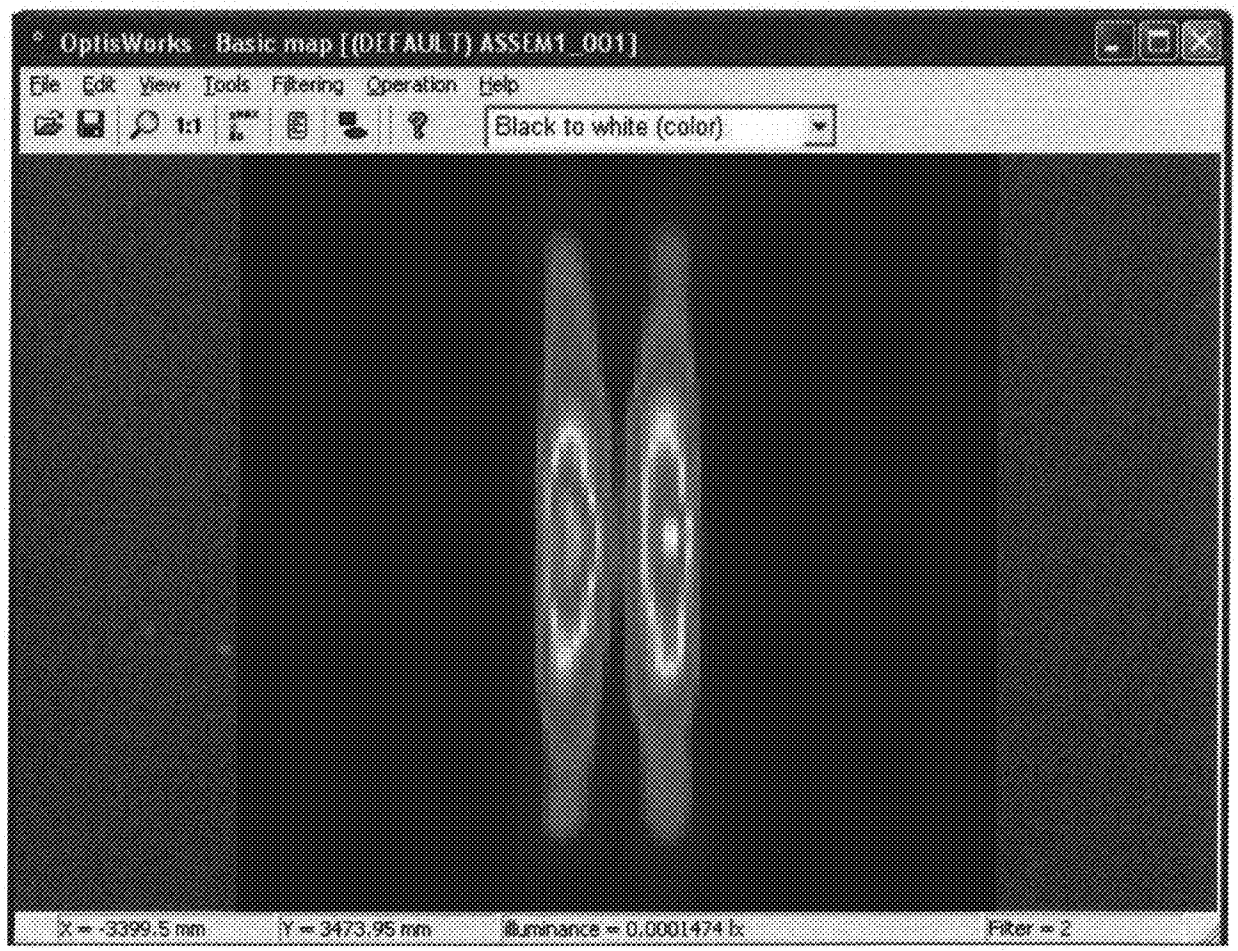

FIGS. 17A and B are actual output patterns from lens 50 of FIG. 1 (FIG. 17A at a higher resolution than FIG. 17B) showing both the perimeter shape and varying intensities within the perimeter shape.

Figure 18A:
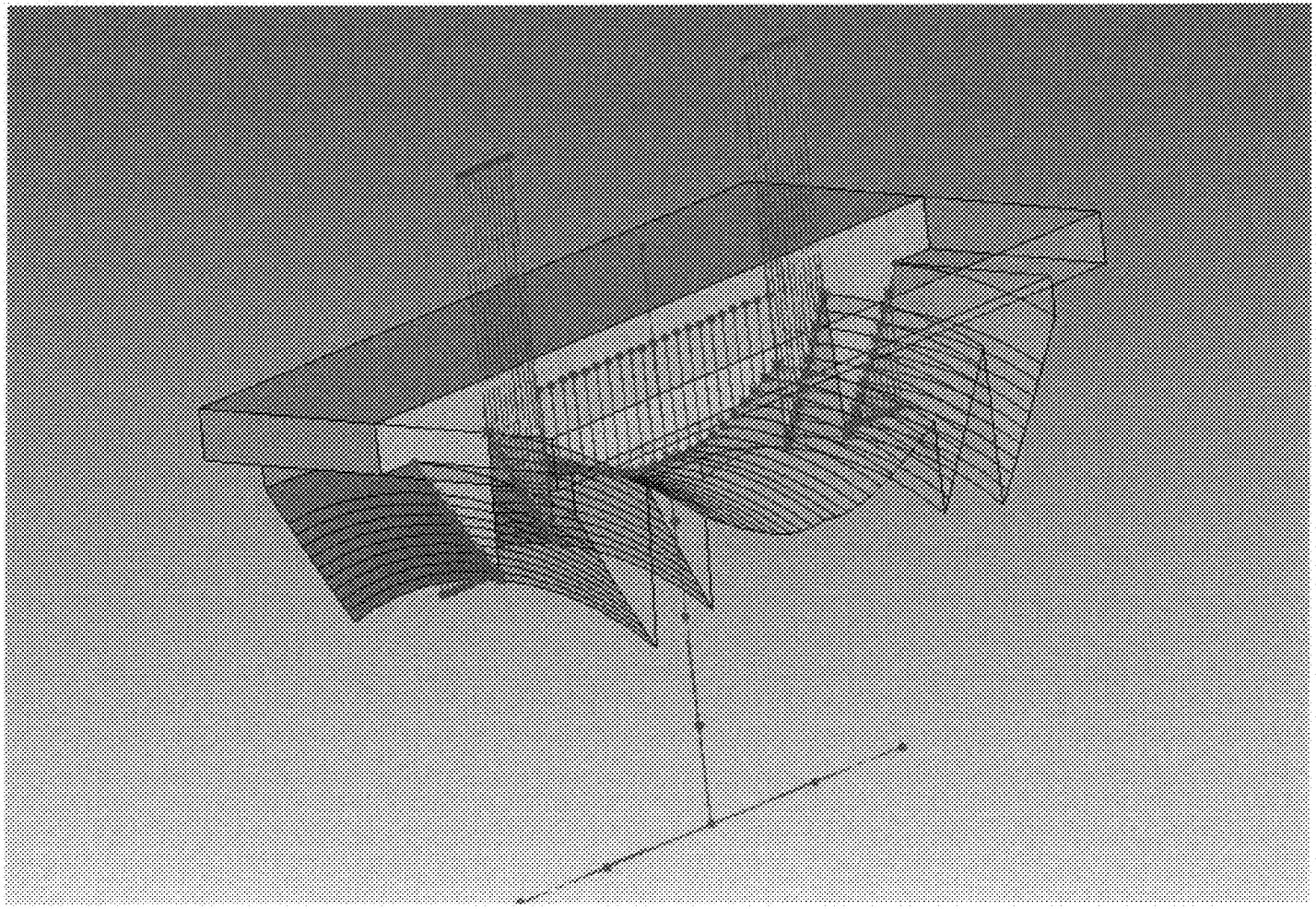

FIGS. 18A and B are detailed to scale perspective and sectional views respectively of lens 50 of FIG. 1, additionally showing reference or data points relative to an X-Y coordinate system which defines a plane through the longitudinal axis of lens 50.

Figure 18B:
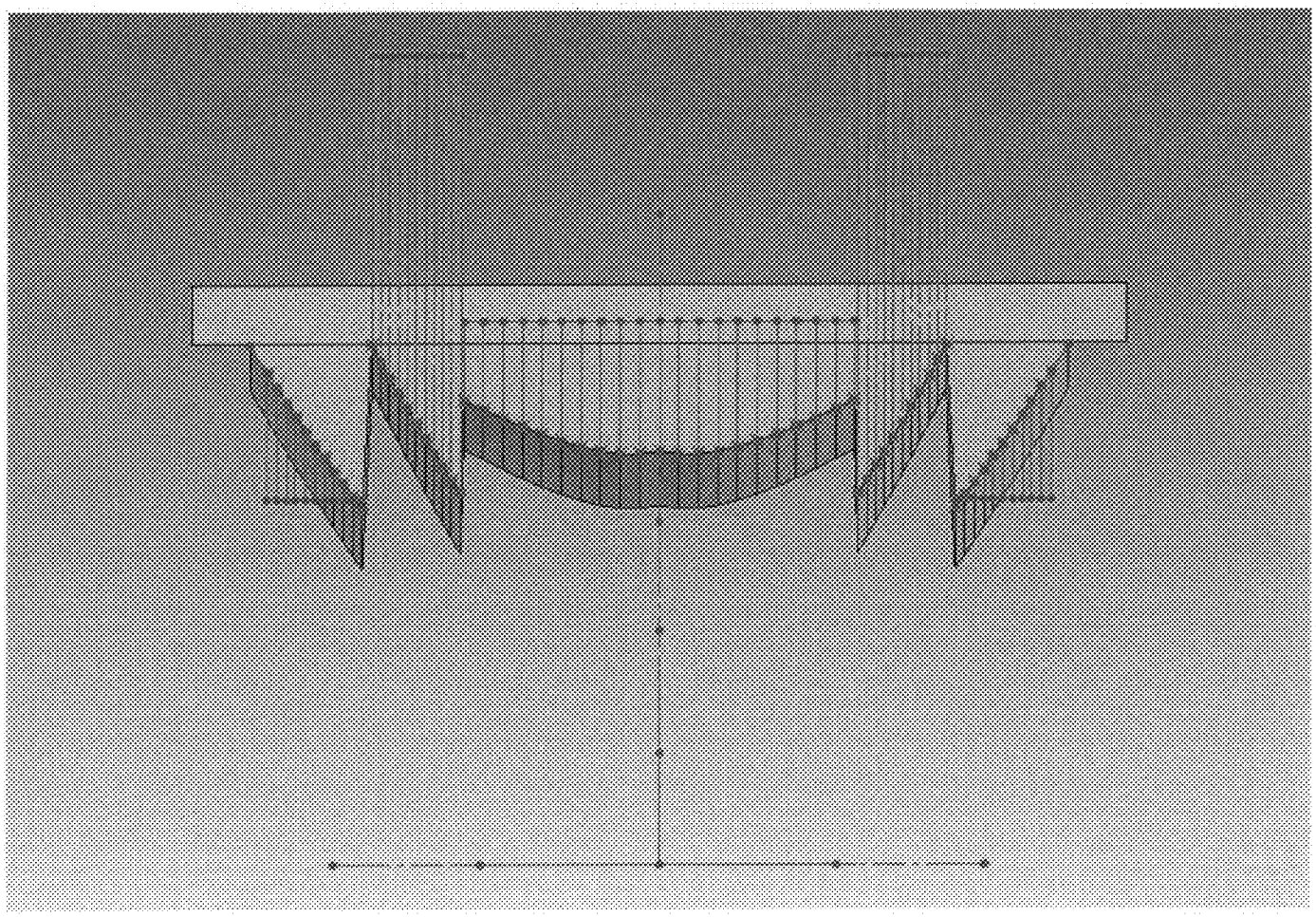
Figure 19B:
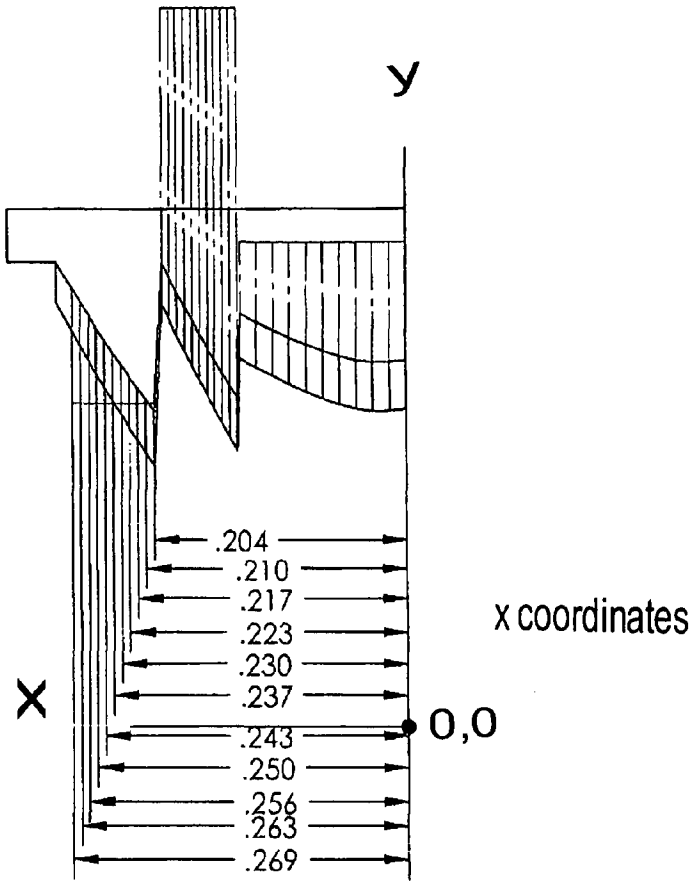
Figure 19A:
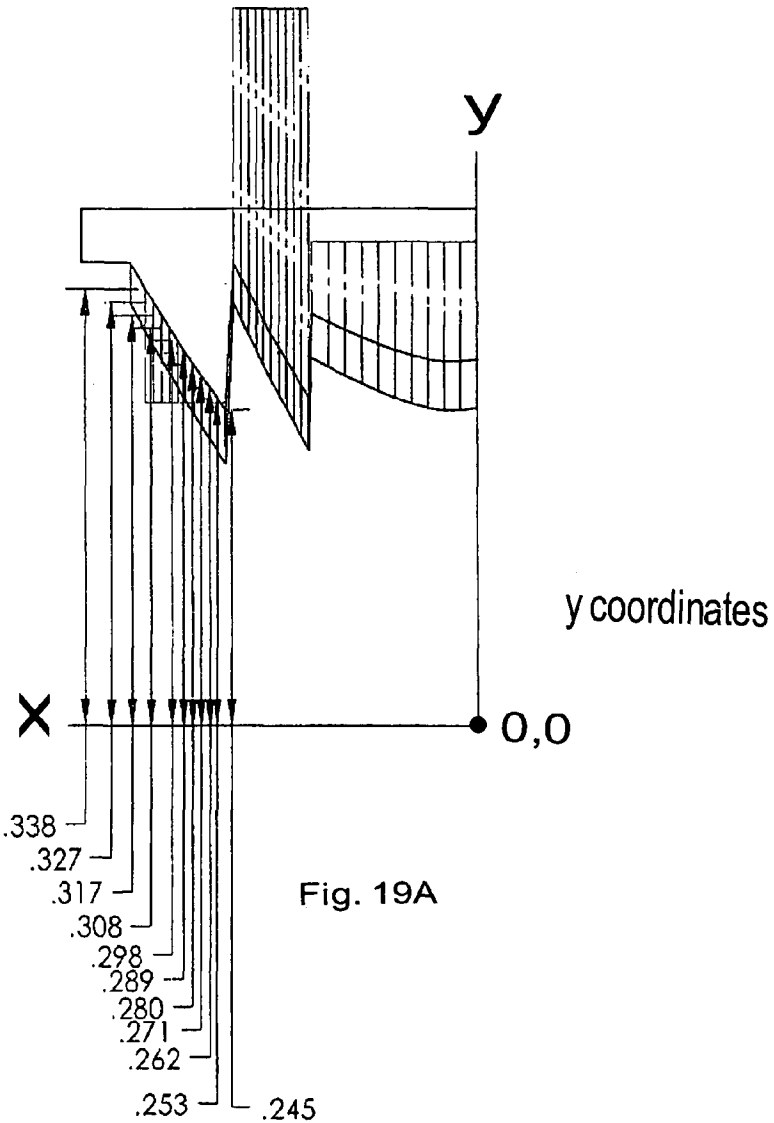

FIGS. 19A and B are depictions of the left half of the sectional view of FIG. 18B with Y and X values respectively of the data points defining the outer Fresnel facet of lens 50 relative to the indicated X-Y plane (FIG. 19A shows distance in inches from a plane extending perpendicularly out of the page and including the X-axis to various points along the lens surface. FIG. 19B shows distance in inches from the Y axis. Using both FIGS. 19A and 19B defines the shape of that part of lens 50.)

Figure 20B:
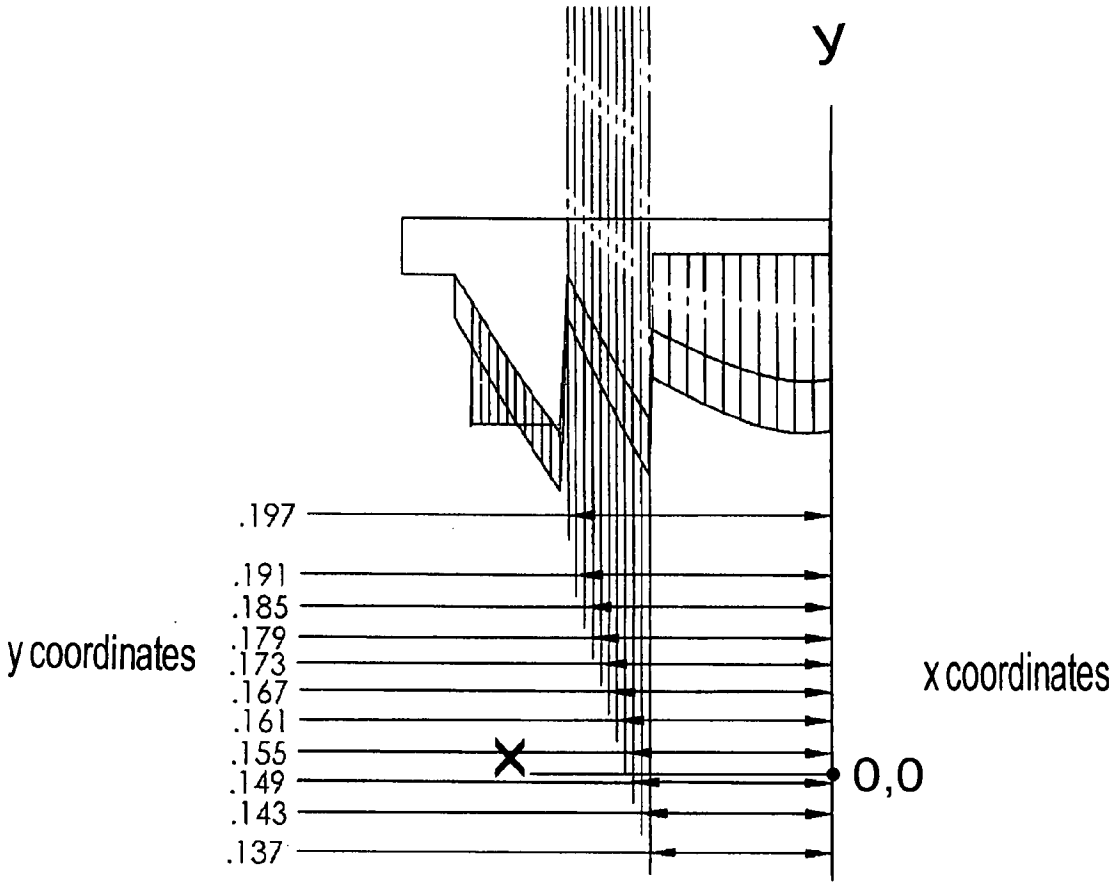
Figure 20A:
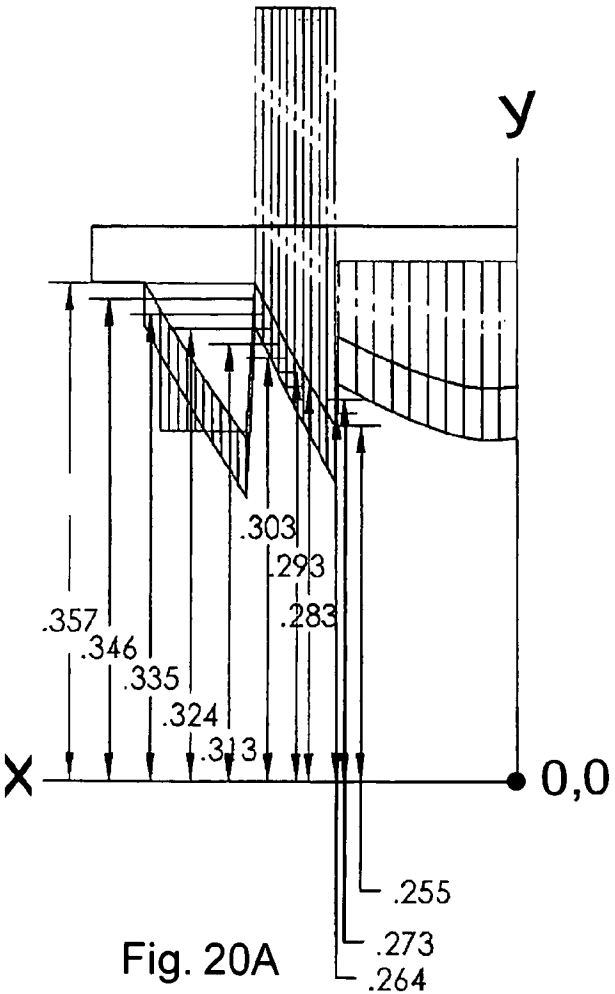

FIGS. 20A and B are similar to FIGS. 19A and B, but give Y and X coordinates or data points respectively for the other or inner-most Fresnel facet.

Figure 21B:
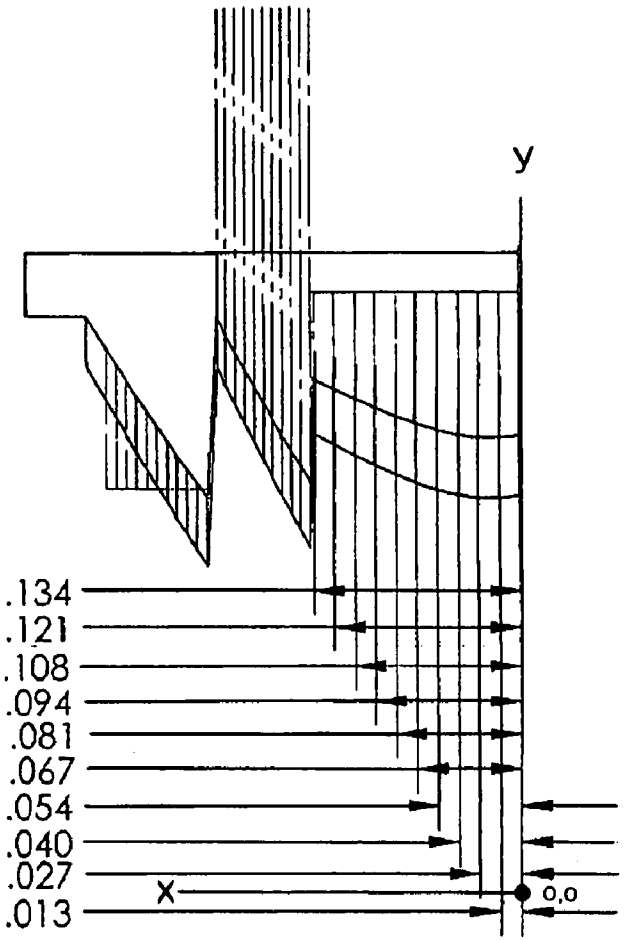
Figure 21A:
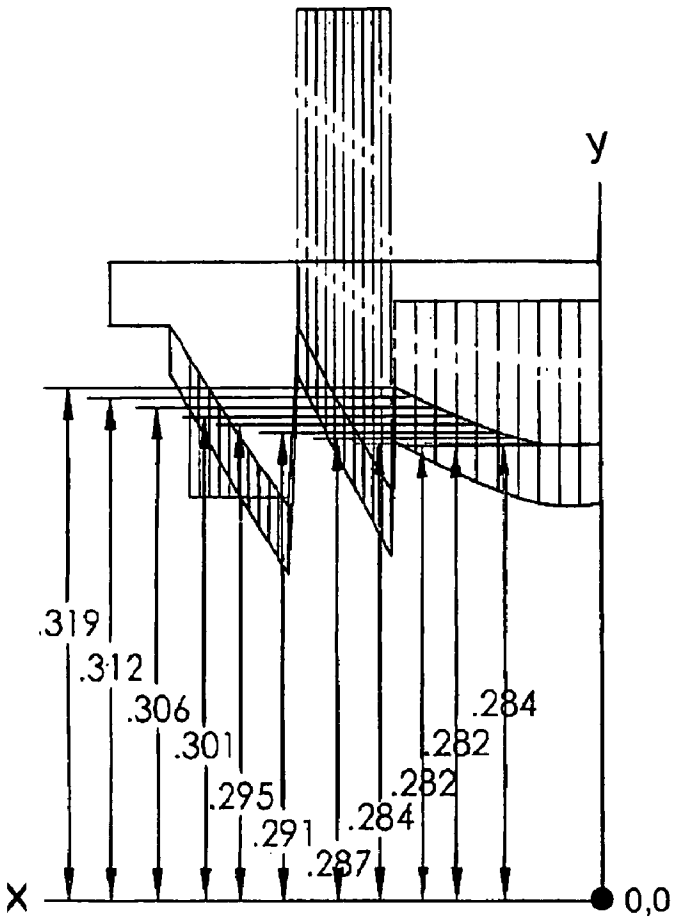

FIGS. 21A and B are similar to FIGS. 19A and B, but give Y and X coordinates or data points respectively for one-half of the inner portion of lens 50.

FIG. 22 is a chart of all the data points indicated in FIGS. 19A and B, 20A and B, and 21A and B, starting at the very outside data point and proceeding point-by-point towards the middle (or origin 0,0). They match up with the dots indicated the data points on the left half of lens 50 in FIGS. 18A and B.

Figure 23:
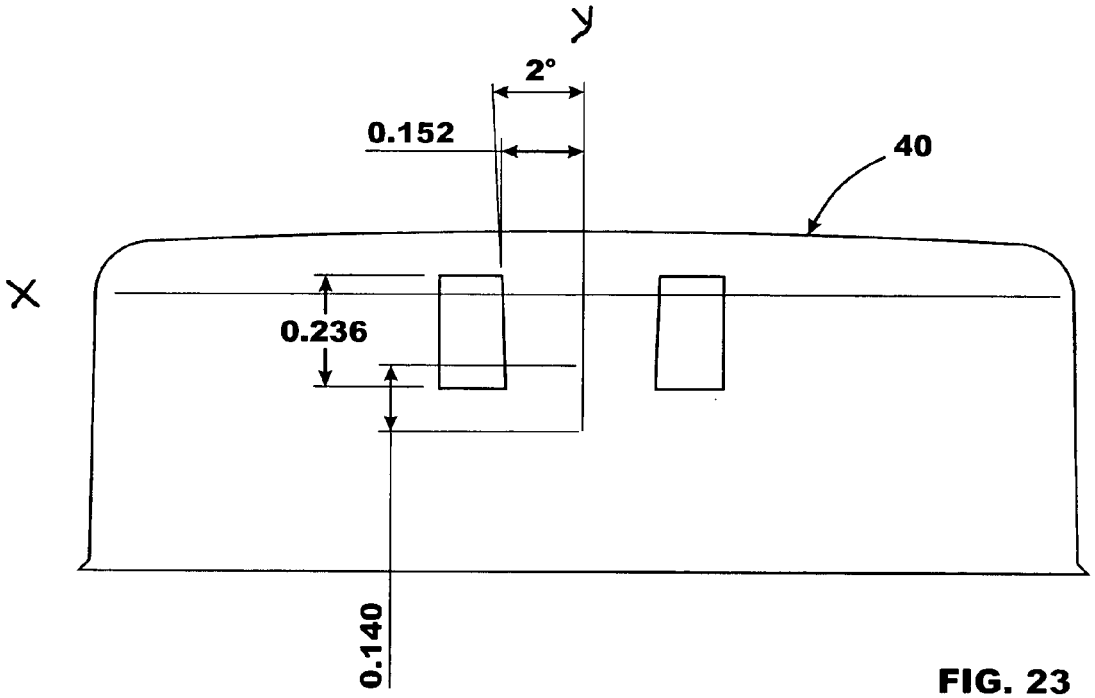

FIG. 23 is a side elevation of cover 40 diagrammatically illustrating the outside dimensions of lens 50 inside it (see dimensions). This illustrates how lens 50 is formed inside cover 40, including the 2 degree angled side wall of lens 50.

IV. DETAILED DESCRIPTION OF EXEMPLARY EMBODIMENTS OF INVENTION

A. Overview

For a better understanding of the present invention, a detailed description of an exemplary embodiment will be set forth below. Frequent reference will be taken to the above-described drawings. Reference numbers and letters will be used to indicate certain parts and locations throughout the drawings. The same reference numerals and letters will be used to indicate the same parts or locations throughout the drawings unless otherwise indicated.

The first exemplary embodiment of the invention will be described in the context of a side marker light for an over-the-road semi-tractor trailer. See reference numeral 10 of FIG. 1, where one side marker light or assembly 10 is shown on side 14 of trailer 12. Light assembly 10 is configured to project a rectangular beam in angle space (reference numeral 20). Beam 20 is designed to comply with DOT/SAE regulations for semi-tractor trailers side marker lights, specifically standard SAE J592 (Rev. December 1994) for "Clearance, Side Marker, and Identification Lamps), available from SAE ("The Society of Automobile Engineers) International, 400 Commonwealth Dr., Warrensdale, Pa. 15096-0001, incorporated by reference herein in its entirety.

It is to be understood, however, that the present invention is not limited to such an application, and as indicated herein, can be applied to a variety of analogous applications, or even to other functions both inside and outside the automotive world.

B. Exemplary Side Marker Apparatus 10

As indicated in FIG. 2, side marker assembly 10 is approximately 2.5 inches in perimeter diameter. It is essentially a round or cylindrical assembly that fits in, and can be installed in, a pre-formed industry-standard size hole or location in the side of semi-tractor trailer 12. It provides the function of marking or showing the side of the large trailer 12, especially in low light or night time situations.

Throughout many of the drawings, reference will be made to a vertical axis V and a horizontal axis H. These axes basically reference a plane that is orthogonal to the ground and to the optical axis of a beam from light source 30. This will help to define and explain the assembly 10 and its output pattern.

FIG. 2 illustrates the basic components of the light assembly 10. A back plate 22 includes opposite sides 24 and 26. An embossment or outward extending mounting structure 36 exists on side 24. A grommet 28 of elastomeric material is configured to provide a seal when mounting light assembly 10 in position.

A single, amber LED 30 (e.g. single Lumileds piranha-style 100° Lambertian output pattern amber LED—part no. HPWTML00, Bins C, D, E, and F available commercially from Lumileds Lighting U.S. L.L.C., San Jose, Calif., USA) is mountable on heat sink/circuit board 32/34, in turn mountable on mounting structure 36). A pair of openings 28 through backing plate 22 allow direct connection of electrical leads 39 through backing plate 22 to a circuit (not shown but well known in the art) powering LED 30. The LED is chosen to have an intensity and beam pattern that cooperates with lens 50 to produce a light output pattern that meets minimum intensity requirements for a semi-trailer amber side marker under the SAE standard incorporated by reference herein.

However, it is to be understood that some side markers are required by standards to be red. Thus, light 10 could also have a red cover 40 and red LED 30 (e.g. Lumileds model HPWTMH00, Bins H, J, L, M), if red is required.

A cylindrical, light-transmissive cover 40 has a tubular side wall 44. An outer end 42 is closed off. Its opposite end 46 is open. An outwardly flared flange 48 surrounds the open end 46. The exterior of cover 40 is generally smooth to deter accumulation of dirt, dust, or other foreign substances. The interior is molded to have certain shapes, as are shown and described.

A lens 50 is generally centered along a central or optical axis O. When assembled, LED 30 would be basically along axis O. Lens 50 is essentially an integral embossment or molded structure extending inwardly from the inside of closed top 42 of cover 40. Lens 50 has a top edge 52, bottom edge 54, and opposite side edges 56 and 58.

More specifics regarding cover 40 are diagrammatically shown in its isometric views of FIGS. 3A-E. In particular, it should be noted how lens 50 occupies a relatively small area of top 42. The remainder of the inside area of top 42 is a retroreflector. It is molded to have a plurality of corner cube retroreflector facets 62 (indicated in some of the Figures by the cross-hatching). The corner cube facets 62 effectively work to create a retroreflective surface for external light incident on assembly 10.

FIGS. 3A-E also illustrate two mounting posts 64 on opposite sides of lens 50. They cooperate with mounting structure 36 of back plate 22 to snap fit, guide, or support it relative to cover 40.

Note also that side wall 44 of cover 40 has parallel, evenly-spaced ridges 66 (e.g. adjacent elongated half cylinder shapes) on its interior. These tend to visually obscure the interior contents of assembly 10 when viewed through side wall 44, and also diffuse light a bit. Circular ridges 68 near open end 46 of cover 40 are stepped regions which facilitate the mating seating of back plate 22 and cover 40. A gasket or grommet 49 can seal cover 40 and plate 22.

As mentioned previously, this embodiment of light assembly 10 has a generally 2.5 inch diameter. As indicated in FIG. 2, side wall 44 is approximately 0.8 inches from back to front. In comparison, lens 50 is approximately 0.3 inches wide and 0.6 inches tall. Thus, the proximate area of lens 50 is 0.18 square inches, whereas the approximate area of the entire top 42 of cover 40 is 6.25 square inches. The area of lens 50 therefore comprises on the order of just 5% of the total area of the top 42 of cover 40. Therefore, the retroreflective surface of side marker assembly 10 is substantial, and meets the regulatory minimums for a side marker despite having built into it a lens 50 that is adapted to generate an illumination beam that also meets those standards.

Thus, in a relatively low profile, small integrated package, both reflective and side marker illumination functions are created. Lens 40 is completely amber. LED 30 can also be amber. This combination produces an amber colored side marker, according to DOT regulations.

C. Operation of Side Marker 10

FIG. 4 roughly (not to scale) diagrammatically depicts side marker 10. LED 30 is shown aligned along optical axis O and positioned in back of lens 50. The output distribution of LED 30 is such that substantial light is incident upon the inside surface of lens 50.

Lens 50 has a middle portion 74 that is a curved surface partially revolved around an axis. At the upper and lower ends 52, 54 of the inner-facing side of lens 50 are mirror image pairs of Fresnel facets. Each pair has an inner facet 76 and an outer facet 78. Side walls 56 and 58 are generally flat but at a 2 degree angle towards the optical axis (one such 2 degree angle is illustrated in FIG. 23 as well as several perimeter dimensions).

The three dimensional shape of lens 50 is illustrated in FIGS. 10 and 18A. Lens 50 is configured to use a single, relatively low intensity LED to create an output pattern that meets the previously cited DOT/SAE regulations for an amber side marker light for semi-trailers. It also creates varying intensity areas in the output pattern. It minimizes light outside the perimeter of the DOT/SAE test pattern area. It is designed to pass the DOT/SAE requirements, but also develops areas of substantially greater intensity at certain areas of the output pattern.

FIGS. 18A and B, 19A and B, 20A and B, 21 A and B, 22, and 23 provide details of the shape of the inner side of lens 50, as discussed below.

FIG. 18A illustrates to scale a three-dimensional view of the entire lens 50. Note that one-half is shown in solid and the near half in wire frame or transparent fashion. A plurality of lines in the near half show the general curvature of certain of the surfaces. Furthermore, a plurality of dots and with X's are shown which indicate data points relative the X-Y coordinates in FIGS. 18A and B. The shape of lens 50 along its longitudinal axis (the interface between the solid and transparent portions of FIG. 18A, can be defined by giving the distances from the X and Y axes to those points. Once those data points are defined essentially lines drawn between the points will fill in the entire shape of the lower surface of lens 50 along that the X-Y plane. That shape is then revolved around the X-axis 2 degrees on either side of the Y axis to complete the surface.

FIGS. 19A and B, 20A and B, and 21A and B, show the data points in Y and X dimensions respectively (in inches) for individual sections of the left half of lens 50. The first data point (X,Y) nearest the outer edge of lens 50 is (0.269 inch, 0.338 inch). The next data point (X,Y) moving inward towards the origin (0,0) is (0.263, 0.327). FIGS. 19A and B show the Y and X values for a cross-section of the outermost Fresnel facet. FIGS. 20A and B shows the same for the inner most Fresnel facet. FIGS. 21A and B show the same for the left half of the central or middle lens surface 74. The right half of lens 50 is simply a minor image.

FIG. 22 puts all the data points in (X,Y) format in one table beginning at the far left data point and moving to the center. Thus, using these data points defines the specific profile of the bottom or inner side of lens 50 inside cover 40. Then, that surface can be completed by forming in the X-Y plane the left half profile described in FIGS. 19-21, creating a minor image for the right side in the X-Y plane, and revolving that profile two degrees in both directions from the X-Y plane (4 degrees total) with the X axis as the axis of rotation.

This description defines both the Fresnel facets or teeth pairs 76 and 78 and the middle portion 74.

FIG. 23 shows that side wall 56 is at a two degree angle to the y axis. Opposite side wall 58 would be a mirror image. The Fresnel facets at opposite ends 50 and 52 of middle portion 74 serve to define two of the limits on opposite sides of the output pattern.

The side walls 56 and 58 of lens 50 define the limits of the other set of opposite sides of the output pattern.

Figure 17B:
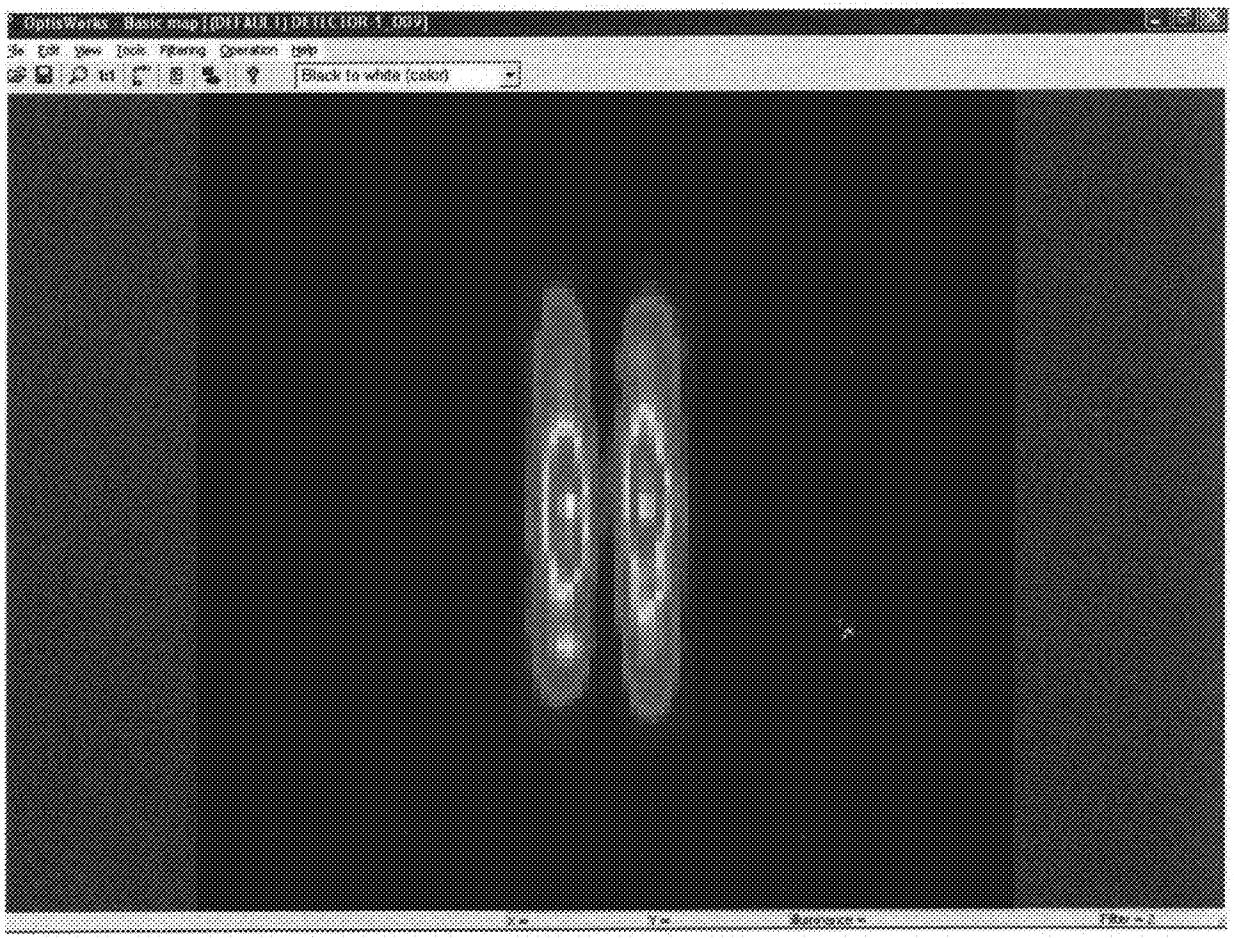

The nature of the surface 74, teeth pairs 76 and 78, and sidewalls 56 and 58 produce an output pattern of roughly of the type indicated at FIG. 9, which pattern is projected onto a flat surface. Note how pattern 20P forms roughly an "X" shape or two side-by-side elongated shapes. FIG. 17A is an actual output pattern. FIG. 17B is the same output pattern as FIG. 17B, but with less resolution. The output pattern is designed in shape and intensity distribution to meet the DOT/SAE standard cited above.

In particular, note in FIGS. 17A and B how the intensity distribution varies in the pattern. The relative amount of intensity is indicated by color. White is highest intensity, followed in decreased magnitude by red, orange, yellow, green, light blue, medium blue, and dark blue, and then black. Each highest intensity area (see white areas in the center of the side-by-side elongated pair of shapes), is surrounded by increasingly larger elongated rings of decreasing intensity. Therefore, the output pattern is essentially two similar side-by-side vertically elongated shapes each having similar intensity distributions.

Thus, a single LED of relatively low intensity can be used to meet the DOT/SAE requirements by using the revolved surface 74, the teeth pairs 76 and 78, and the sidewalls 56 and 58. This combination of lens 50 transforms a generally conical output pattern of LED 30 into a rectangular beam 20. As indicated by the projection 20P of beam 20 on a vertical surface in FIG. 4, beam 20 is rectangular in its cross-section. As shown more precisely at FIG. 17A, it is narrower in width W along horizontal axis H than tall T along the vertical axis V. Lens 50 reshapes the output of LED 30 into a rather small (+/−10° on opposite sides of axis T) and somewhat wider (+/−45° on opposite sides of axis H) rectangular pattern which closely follows the test area for DOT/SAE regulations cited above for side markers.

By reconfiguring the spherical pattern of LED 30 into the rectangular pattern 20, the output of a single LED can be meets minimum DOT/SAE intensity requirements for a side marker. In comparison, state of the art side marker lights that merely use a tinted amber cover or very simple optical surfaces, cannot meet DOT requirements using a single LED. They tend to use multiple LEDs to get sufficient intensity or use higher powered incandescent sources.

Additional general diagrammatic (not to scale) illustrations regarding how beam pattern 20 is created are set forth at FIGS. 5 and 6. FIG. 5 is a cross-section of lens 50 in the plane indicated by line 5-5 in FIG. 4. Several light rays are diagrammatically indicated in FIG. 5 to show how the elements of lens 50 control spread of light in the vertical plane.

Single LED source 30 is diagrammatically indicated at focal point 30 in FIG. 5. Middle area 74 of side 70 of lens 50 facing light source 30 presents a generally curved shape as described above. Inner and outer facets 76 and 78 essentially are tooth-shaped in cross-section. Rays such as 80 and 81 would emanate from light source 30 and impinge curved surface 74 (see first portions of those rays at reference numerals 80A and 81A). Surface 74 would refract those rays and they would traverse the interior of the material of lens 50 (see ray portions 80B and 81B). They would further refract at the exterior side 72 of lens 50 and only slightly diverge in angle space (see beam portions 80C and 81C). In comparison, outer rays 82 and 83 would emanate from source 30 and strike the inner surface of facets 76 and 78 (see ray portions 82A and 83A). They would refract inside facets 76 and 78 (see portions 82B and 83B) and then internally reflect (by total internal reflection or TIR) on the opposite side of facets 76 and 78 (see ray portions 82C and 83C). They would then issue from the external surface 72 of lens 50 in basically a controlled, vertically-limited fashion (see portions 82D and 83D). The top half of lens 50 would handle light from light source 30 in essentially the same way (exemplary rays for the top half in FIG. 5 are omitted for simplicity). As can be seen by FIG. 5, the configuration of lens 50, in its vertical cross-section, therefore controls the vertical spread of beam 20 from optical axis O.

This would form the upper and lower boundaries of beam 20 as shown in FIG. 4. By selection of the cross-sectional profile of lens 50, the intensity distribution vertically can be controlled to also control intensity distribution within pattern 20 to a certain extent as discussed above and shown in FIG. 17A.

In comparison, FIG. 6 shows a cross-section of lens 50 in a plane indicated by line 6-6 of FIG. 4. Surface 70, the curved surface, is basically a surface of partial revolution of generally hyperbolic characteristic. As indicated by rays 85, 86 and 87, the surface would serve to refract light from source 30 (see portions 85A, 86A, and 87A). Rays near optical axis O would pass through the interior of lens 50 and refract at the exterior surface 72 (see portions 85B and 86B), and further refract at output surface 72 in a controlled, limited beam spread (see portions 85C and 86C). Rays near the outside of source pattern 30 would impinge lens surface 74 (see portion 87A), partially traverse the interior of lens 50 (portion 87B), but then reflect by TIR and refract at outer surface 72 (see portion 87C) resulting in output ray 87D. In this manner, the outside perimeter of the horizontal spread of beam 20 can be controlled to create the limits of width W of beam 20 (see FIG. 4).

It can therefore be seen that a relatively economical integration of lens 50, by molding into the plastic cover 40 and positioning a single LED behind it in relatively close proximity, can create a concentrated, controlled distribution pattern of LED light energy in angle space. This control and concentration allows a single LED output to meet the minimum DOT/SAE requirements cited above.

FIGS. 7 and 8 show opposite sides of back plate 22. Side 24 of back plate 22 includes mounting pins 90. They are useful to align the printed circuit board (PCB). A depression 92 is used for potting compound to seal the light. Also aperture 94 is used to allow potting compound to flow through from behind.

Side 26 of backing plate 22 (FIG. 8) illustrates plug-ins or openings 38 through which wires 39 (see FIG. 2) can pass. Grommets can be positioned in those sockets around openings 38 to seal the interior of assembly 10. Ears 98 extending on opposite sides of raised portion 96 can facilitate mounting of assembly 10 to semi-tractor trailer 12.

FIG. 9 is a diagrammatic illustration of output pattern 20P for a 2.5 in. dia. amber semi-trailer side marker light according to FIGS. 1-23.

Lens 50 is designed to effectively operate to create an output distribution 20 of a light intensity which meets or exceeds the regulatory requirements. But additionally, because the projected pattern 20P of lens 50 is controlled to basically substantially follow the perimeter of test pattern 100, little light is wasted by extending outside of that pattern 100. Still further, light is concentrated into higher intensity regions of the output (see FIG. 17A).

For purposes of comparison, reference can be taken also to FIG. 1. Conventional state-of-the-art incandescent side markers project a wide circular pattern (see dashed line surrounding pattern 20). Substantial light is wasted because it falls outside of what will be tested for minimum intensity. As previously mentioned, however, the conventional thought is incandescent sources are so cheap that higher powered incandescent sources are utilized to blast light out in a big circular pattern with intensity to exceed all of the test points within the much smaller rectangular test area. However, this is inefficient regarding light energy and power. It also relies on the less durable and shorter lasting incandescent lights.

Also, conventional state-of-the-art side markers using multiple LEDs (to try to get enough intensity out), also broadcast light in a much wider pattern than the rectangular regulatory test pattern and uses several LEDs which can be relatively expensive.

Thus, the combination of the light control in lens 50 with the LED source 30, even though a single source, achieves light distribution standards for DOT/SAE side marker regulations cited above efficiently.

D. Options and Alternatives

It will be appreciated that the foregoing exemplary embodiment is but one form the invention can take. The invention is not limited to that embodiment but indeed can be implemented in a variety of different forms and configurations for a variety of different applications. Variations obvious to those skilled in the art will be included in the invention which is defined solely by the claims appended hereto.

For example, side marker assembly 10 does not need to include the retroreflective surface. The advantage is that in one assembly, in a cost effective manner, both the illumination output pattern and enough surface area for meeting reflective regulations can be met. For many state-of-the-art incandescent sources, or even multiple LED sources, there is not sufficient surface area for a retroreflector to be integrated in the fixture for the size constraints of a standard 2.5 inch diameter side marker. This would require a separate retroreflector to be utilized for DOT regulations, which multiplies the cost and the number of devices to maintain. The relatively small size, the particular output width, and the power of the single LED 30 allows relatively small lens 50 to produce the pattern meeting the minimum intensity levels at the test points.

The materials for the components can vary according to need. In the exemplary embodiment, cover 40 is a molded plastic (such as polycarbonate) in an amber color. The external surfaces are basically smooth so that they deter the accumulation of dust or dirt. The surface variations of lens 50, corner cube reflective surface 62, and side ridges 66 are formed on the interior of cover 40.

Light source 30 can also vary. However, the first exemplary embodiment described herein is adapted for utilization of the 100° circular output, piranha-type LED. Examples of color could be red or amber, depending on where the light is placed.

The mounting structure for LED 30 can also vary. Heat sink/circuit board 32/34 could be separate members or integrated. Other manners of handling heat from LED 30 could be utilized. Instead of wires 39, there could be a plug-in assembly.

Also, as can be appreciated, the size of the light assembly can be scaled up or down from that shown in the exemplary embodiments in the Figures. For example, the side marker of FIG. 2 could be scaled up at least twice its size or scaled down at least to one-half size of what is shown.

Further examples of options and alternatives are set forth below.

The shape of the light assembly can vary. As shown in FIG. 10, an alternative form of a light assembly according to the present invention can be similar to light assembly 10 but have a cover 120 which is rectangular in shape. As with cover 40 of assembly 10, cover 120 has a smooth exterior top side 121, long sides 125 and 126, short sides 123 and 124, and an open edge 122. Some side markers or other types of automotive lights are either required or desired by the owner/operator of the vehicle to be this shape instead of circular. The basic functions of assembly 10 would remain. Rectangular lens 50 would be positioned at generally the optical center of the light assembly. For a rectangular output distribution of the type, lens 50 could be basically the same as previously described with embodiment 10. Retroreflection facets 128 (like corner cube facets 62) for embodiment 10, can be molded into the interior of this embodiment cover 120 if sufficient surface area exists or if needed for a particular application. A single LED (like LED 30) and appropriate mounting structure on backing plate could be utilized and snap fit into grooves or ridges 127. Embodiment 120 would therefore form a rectangular-shaped light that would produce a rectangular pattern 20 from a single LED source and also have a much larger surface area reflective surface compared to the area of lens 50.

FIG. 11 depicts another embodiment called a tongue light. Its cover member (reference numeral 130) would have a narrower rectangular-shaped middle section 131 with lens 50 molded on the interior side. A single LED would be positioned behind lens 50 to issue a rectangular output pattern. On either side of middle section 131 would be larger area sections 132 and 133. In this approximately 6 inch long cover, the remainder of cover 130 could be molded for reflective properties (e.g. corner cubes—see reference numeral 136). This again allows a relatively small area of the assembly to be dedicated to producing a controlled rectangular output pattern from a single LED with a relatively large proportion of that light serving as a retroreflective area. It could snap-fit onto a back or base or otherwise be secured.

FIG. 12 illustrates a trailer 140 which can be pulled behind a car, pickup, or SUV (such as a horse trailer). It illustrates a number of different types of lights that might be used with or required for such trailers. For example, clearance lights 144 could be 2.5 inch diameter round lights around the top of the back of trailer 140. They could be red.

Multi-function red rear lights 142 could include stop, turn signal, and running taillight functions. Fender lights 150 on each fender 146 above each wheel 148 could be red and mark the location of those wider portions of trailer 140.

In each of those cases, a combination similar to that of assembly 10 could be utilized. A relatively small area lens 50 (shown only in lights 142 and 150) in front of a single LED source could project a controlled-in-shape-and-intensity distribution beam 20. If regulations require, it can be designed for a particular output pattern distribution minimum(s). The remainder of the cover area may or may not be configured to have reflective properties depending on different factors mentioned herein. This is even true for multi-function lights 142.

FIG. 13 shows an alternative configuration for a fender light (here indicated generally by reference number 150). A red lens cover has a majority of its rear facing area 152 configured into a diamond cut reflector. In the middle is lens 50 in front of a single LED source. A housing 154 can surround and protect lighting fixture 150 and allow it to be surface-mounted on fender 146 (see FIG. 12). An extension housing 156 can encase electrical wires 158 and allow them to be mounted on the surface of a fender 146 as well as protect the wires.

FIGS. 14A and B show (in perspective and side elevation) a still further embodiment of a fender light. In this embodiment, the rearward facing side of the light has a red lens 162A with lens 50 centered in it to project a rectangular output pattern. The remainder of lens 162A is a red reflector. On the opposite side of housing 164, and facing forward, would be an amber lens 162B with a center lens 50 that would project a rectangular amber pattern. The remainder of lens 162B may or may not be an amber retroreflector.

This embodiment 160 has two light assemblies—a single LED (not shown) under a red cover 162A with center lens 50 facing rearward; and another single LED (not shown) under an amber cover 162B with center lens 50 facing forward, when installed in operative position. The LEDs are mounted in base 164 and covers 162A and B snap or are otherwise secured to base 164. A controlled, projected amber light pattern is directed forward from lens 50 in a manner such as previously described, and a red light pattern rearward. And, as previously described, the remainder of covers 162A and B can serve as retroreflectors, one amber and one red.

By referring again to FIG. 1, a variety of other vehicle lights are indicated. A tractor could utilize a fixture according to the present invention for its multi-function stop/turn/taillight. Clearance lights at the top 16 and/or back 18 of trailer 12 could also utilize the present invention. The tractor pulling trailer 12 could also utilize them for their various functions, e.g. running lights or brake/turn/tail lights 24.

FIG. 15 shows a still further exemplary embodiment that could utilize concepts of the present invention. This box light 170 could have inside its housing 172 a stop/turn/taillight 176 having a lens 50 to project a rectangular-in-angle-space running taillight (in red). The remainder of the cover portion 60 could be corner cube for reflective properties. As indicated at FIG. 16, brake lights or turn signal lights could be separately incorporated on opposite sides of lens 50.

Additionally, in an integrated unit in housing 172, a red side marker assembly 174 (like cover 120 of FIG. 10) could be mounted and use a lens 50 to project a side rectangular amber output pattern, as well as have a substantial portion 60 function as a red side reflector. Still further, if on left side of the trailer, there could be a license plate light 178 in the device. This entire device 170 could be installed on each side of the rear of a vehicle or trailer. Note FIG. 15 illustrates the multi-functions by the following abbreviations:

| | |
|---|---|
| F1 | amber side light |
| F2 | amber side retroreflector |
| F3 | red stop |
| F4 | red turn |
| F5 | red tail |
| F6 | red retroreflector |
| F7 | license plate light |

FIG. 16 illustrates another exemplary embodiment of a stop/turn/tail light according to the present invention. This embodiment 180 includes a rear running light/brake light portion 182 with six lenses 50 (and an LED 184 behind each). By varying the intensity of the LEDs, running light function and brake light function can be achieved. Three turn signal LEDs 186, each behind a lens 50, could function as a turn signal light. An area or areas of the remainder of the rearward facing surface area of portion 182 may or may not be a retro-reflector 60. A set of mirror image lights 180 could be placed on opposite sides of the back of a vehicle or trailer.

It is therefore indicated that the invention can be embodied in a number of different ways. Just with regard to automotive uses, examples of the types of uses are amber 2.5 inch round side marker lights, amber 2 inch by 3 inch rectangular side markers, 2 inch diameter red taillights, 6 inch rectangular side markers in either red or amber, 1 inch diameter fender lights, or multi function taillights or even the multi light box light of FIG. 15. Similarly, other applications, even in non-automotive fields, are possible.

Whether or not a retro-reflective surface is incorporated depends primarily on application of the light (e.g. location and function for the vehicle and trailer) and physical constraints (e.g. is there enough surface area).

It can therefore be seen that the invention achieves at least all of its stated objectives, features, advantages and aspects.

What is claimed is:

1. An apparatus for creating an output distribution pattern from a single LED light source producing a generally conical output beam along an optical axis comprising a. an at least partially light transmissive cover member adapted for placement along the optical axis;

b. the cover member comprising a lens portion adapted for placement along the optical axis;

c. the lens portion including:

i. a generally rectangular shape, ii. opposite short sides and opposite long sides, iii. a generally revolved center section, and iv. at least one Fresnel-shaped projection at or near each opposite long side.

2. The apparatus of claim 1 wherein the lens portion being configured to create an output distribution pattern which:

a. has a pre-determined perimeter shape different from the conical output beam of the LED light source; and b. has areas of differing intensity within the perimeter shape.

3. The apparatus of claim 1 wherein the LED comprises a piranha-type LED.

4. The apparatus of claim 3 wherein the LED projects approximately a 100° conical output beam.

5. The apparatus of claim 1 wherein the cover member comprises a face and a side wall.

6. The apparatus of claim 5 wherein the face is round and the side wall is cylindrical.

7. The apparatus of claim 6 wherein the face is approximately 2.5 inches in diameter.

8. The apparatus of claim 7 wherein the cover member is amber or red in color.

9. The apparatus of claim 1 wherein the cover member is adapted for use as a side marker light for an over-the-road semi-trailer.

10. The apparatus of claim 1 installed in opposite front-facing and rear facing positions, respectively, on a fender light adapted for placement on or integration with a fender of a trailer or automobile.

11. The apparatus of claim 5 wherein the lens comprises the lens is integral with the face of the cover member.

12. The apparatus of claim 11 wherein the area of the lens is a fraction of the total area of face of the cover member.

13. The apparatus of claim 12 wherein the fraction of area of the lens is less than 10% of the total surface for the cover.

14. The apparatus of claim 13 wherein less than 10% is approximately 5%.

15. The apparatus of claim 6 wherein the face of the cover member further comprises a reflector portion outside of the lens portion.

16. The apparatus of claim 15 wherein the reflector portion comprises a retroreflector.

17. The apparatus of claim 16 wherein the retroreflector comprises corner cube facets.

18. The apparatus of claim 1 wherein a surface of the lens is revolved around an axis and radially swept through a profile to compress the output of the LED vertically and horizontally.

19. The apparatus of claim 18 wherein the surface of the lens is generally a revolved hyperboloid shape.

20. The apparatus of claim 18 wherein the surface of the lens is raised, has side walls and end walls, and comprises at least one Fresnel facet at each end wall.

21. The apparatus of claim 20 further comprising a pair of Fresnel facets at each end wall.

22. The apparatus of claim 21 wherein the pair of Fresnel facets are adapted to define opposite sides of a rectangular output distribution pattern.

23. The apparatus of claim 22 wherein the sidewalls are adapted to define other opposite sides of the rectangular output distribution pattern.

24. The apparatus of claim 23 wherein the lens revolved surface produces areas of higher intensity in the output distribution pattern.

25. The apparatus of claim 1 wherein the lens is configured to distribute intensity of light throughout the output distribution pattern in a predetermined distribution.

26. The apparatus of claim 25 wherein the predetermined distribution is correlated to a regulatory test pattern with a plurality of test points having minimum intensity requirements.

27. The apparatus of claim 26 wherein the output distribution pattern is designed to meet minimum intensity requirements for all test points.

28. The apparatus of claim 27 wherein the output distribution pattern is designed to substantially exceed minimum intensity requirements for some of the test points.

29. The apparatus of claim 1 in combination with a back plate and single LED source mounted on the back plate.

30. The apparatus of claim 6 further comprising ridges on sidewall adapted to at least partially optically obscure the interior of the cover member when viewed through the sidewall.

31. A method of producing an output distribution pattern which differs from a generally conical output beam of a single LED light source comprising:

a. reshaping the generally conical output beam of the single LED by passing it through a lens portion having a generally rectangular shape, opposite short sides and opposite long sides, a generally revolved center section, and at least one Fresnel-shaped projection at or near each opposite long side; and b. producing an output pattern with a generally rectangular perimeter and areas of differing intensity within the reshaped perimeter.

32. The method of claim 31 wherein the conical output beam is created from a piranha-type LED.

33. The method of claim 32 wherein the piranha-type LED projects approximately a 100° conical output beam.

34. The method of claim 31 wherein the LED is of relatively low intensity.

35. The method of claim 31 wherein the step of reshaping comprises directing the conical beam through a lens comprising a revolved hyperboloid surface.

36. The method of claim 31 applied to the function of an amber side marker light for an over-the-road semi-trailer.

37. The method of claim 31 further comprising providing retroreflectance in areas.

38. The method of claim 31 wherein the output distribution pattern is correlated to a regulatory test pattern with a plurality of test points having minimum intensity requirements.

39. The method of claim 38 wherein the output distribution pattern is designed to meet minimum intensity requirements for all test points.

40. The method of claim 39 wherein the output distribution pattern is designed to substantially exceed minimum intensity requirements for some of the test points.

41. The apparatus of claim 1 wherein the apparatus comprises a tongue light.

42. The apparatus of claim 1 wherein the apparatus comprises a tail light.

43. The apparatus of claim 1 wherein the apparatus comprises a trailer tail light.

44. The apparatus of claim 1 wherein the apparatus comprises a fender light.

45. The apparatus of claim 44 further comprising a second single LED light source with a second at least partially light transmissive cover member and lens portion, generally back-to-back.

46. The apparatus of claim 45 wherein the second cover member is a different color than the said cover member.

* * * * *